US008130176B2

(12) United States Patent
Kasai et al.

(10) Patent No.: US 8,130,176 B2
(45) Date of Patent: Mar. 6, 2012

(54) ELECTRO-OPTICAL APPARATUS AND METHOD OF DRIVING THE ELECTRO-OPTICAL APPARATUS

(75) Inventors: Toshiyuki Kasai, Okaya (JP); Yoichi Imamura, Chino (JP); Tokuro Ozawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 885 days.

(21) Appl. No.: 12/219,535

(22) Filed: Jul. 23, 2008

(65) Prior Publication Data

US 2008/0316151 A1 Dec. 25, 2008

Related U.S. Application Data

(63) Continuation of application No. 10/843,377, filed on May 12, 2004, now Pat. No. 7,714,810.

(30) Foreign Application Priority Data

May 19, 2003 (JP) ..... 2003-140973
Mar. 23, 2004 (JP) ..... 2004-084651

(51) Int. Cl.
*G09G 3/30* (2006.01)

(52) U.S. Cl. ..... 345/76; 345/82

(58) Field of Classification Search ..... 345/76–85, 345/204

See application file for complete search history.

(56) References Cited

U.S. PATENT DOCUMENTS 5,856,686 A 1/1999 Watanabe et al.
6,373,454 B1 4/2002 Knapp et al.
6,522,315 B2 2/2003 Ozawa et al.
6,525,704 B1 2/2003 Kondo et al.
6,683,645 B1 * 1/2004 Collins et al. ..... 348/294
6,697,057 B2 * 2/2004 Koyama et al. ..... 345/204
6,858,991 B2 2/2005 Miyazawa
7,012,597 B2 * 3/2006 Kasai ..... 345/204
7,015,884 B2 3/2006 Kwon
7,193,591 B2 * 3/2007 Yumoto ..... 345/82
7,791,568 B2 * 9/2010 Yamada et al. ..... 345/76
7,808,451 B1 * 10/2010 Rutherford ..... 345/45
2003/0103022 A1 6/2003 Noguchi et al.
2003/0112205 A1 6/2003 Yamada
2003/0112208 A1 6/2003 Okabe et al.
2003/0122747 A1 * 7/2003 Shannon et al. ..... 345/76
2005/0225518 A1 * 10/2005 Yamada et al. ..... 345/77
2008/0174527 A1 * 7/2008 Hattori ..... 345/76

FOREIGN PATENT DOCUMENTS

CN 1122165 A 5/1996

(Continued)

OTHER PUBLICATIONS

Foreign Office Action dispatched Mar. 1, 2011 in Japanese Application No. 2007-202627 (with translation).

(Continued)

*Primary Examiner* — Nitin Patel

(74) *Attorney, Agent, or Firm* — Oliff & Berridge, PLC

(57) ABSTRACT

The invention provides an electro-optical apparatus that can prevent a shift in a threshold voltage of an amorphous silicon transistor while driving an organic EL device in a pixel circuit including the amorphous silicon transistor. A characteristic-adjustment circuit can be provided, which has a function of returning a shift in the threshold voltage of the amorphous silicon transistor included in the pixel circuit to the original state.

9 Claims, 18 Drawing Sheets

FOREIGN PATENT DOCUMENTS

| | | | |
|---|---|---|---|
| CN | 1361510 | A | 7/2002 |
| JP | A-2000-347621 | | 12/2000 |
| JP | A-2002-517806 | | 6/2002 |
| JP | A-2002-221936 | | 8/2002 |
| JP | A-2003-043993 | | 2/2003 |
| JP | A-2003-186437 | | 7/2003 |
| JP | A-2003-208127 | | 7/2003 |
| JP | A-2004-029247 | | 1/2004 |
| KR | 2002-056353 | A | 7/2002 |
| KR | 2003-001530 | A | 1/2003 |
| KR | 2003-0022693 | A | 3/2003 |
| WO | WO 94/25954 | | 11/1994 |
| WO | WO 98/36407 | | 8/1998 |
| WO | WO 03/001496 | A1 | 1/2003 |

OTHER PUBLICATIONS

Foreign Office Action dispatched Mar. 1, 2011 in Japanese Application No. 2007-202628 (with translation).

Jun. 7, 2011 Office Action issued in Japanese Application No. 2007-202628 (with translation).

"Casio Ventures into Organic EL Panels Driven by Amorphous Si TFT"; Nikkei Electronics, 2003.

* cited by examiner

ELECTRO-OPTICAL APPARATUS AND METHOD OF DRIVING THE ELECTRO-OPTICAL APPARATUS

This is a continuation of application Ser. No. 10/843,377 filed May 12, 2004. The disclosure of the prior application is hereby incorporated by reference herein in its entirety.

BACKGROUND OF THE INVENTION

1. Field of Invention

The present invention relates to an electro-optical apparatus using a current-driven device that is driven by an applied current as a light-emitting device and to a method of driving the electro-optical apparatus.

2. Description of Related Art

Display apparatuses using liquid crystals have become increasingly used as thin displays in recent years. Displays of this type consume lower power and occupy less space, compared with cathode ray tube (CRT) displays. Hence, it is important to utilize the advantages of such displays to manufacture lower-power-consumption and more-compact displays.

Displays of this type include displays using current-driven light-emitting devices, instead of liquid crystal devices. Since current-driven light-emitting devices are self luminous devices, which emit light in response to a supplied current, unlike liquid crystal devices, they need no backlight and, therefore, they can accommodate the marketing demand for low power consumption. Furthermore, current-driven light-emitting devices have superior display performance including wider viewing angle and higher contrast ratio. Among such current-driven light-emitting devices, electroluminescent devices (EL devices) are especially appropriate for displays because large-area and high-resolution EL devices can be realized in full color.

Among EL devices, organic EL devices have drawn attention because of their high quantum efficiency.

FIG. 10(*a*) illustrates an example of a circuit (pixel circuit) for driving such an organic EL device. FIG. 10(*b*) is a timing chart showing the operation of the circuit in FIG. 10(*a*). Referring to FIG. 10(*a*), a pixel circuit 201 includes two transistors, that is, an n-type transistor T8 and a p-type transistor T9, a data-holding capacitor C, and an organic EL device 11. The transistor T9 is switched by a signal supplied through a gate line 12, and a data signal Vdata supplied through a data line 13 is held in the data-holding capacitor C as an electric charge. The electric charge held in the data-holding capacitor C causes the transistor T8 to be conductive and, thus, a current corresponding to the data signal Vdata is supplied to the organic EL device 11, which emits light. See, for example, PCT Publication No. WO98/36407.

SUMMARY OF THE INVENTION

Current-driven light-emitting devices, such as organic EL devices, are more easily controlled with a current than with a voltage. This is because the luminance of the organic EL device is determined based on a current and, therefore, the organic EL device can be more accurately controlled by using the current as a data signal. In addition, for example, when transistors having different polarities, including n-type transistors and p-type transistors, are combined to constitute a pixel circuit, the manufacturing process is more complicated, compared with a case in which transistors having either type are combined to constitute a pixel circuit. Accordingly, it is an object of the present invention to provide a pixel circuit that can receive a current as a data signal and that includes transistors being the same-type.

Furthermore, depending on the manufacturing process of the transistors, it is possible that only n-type transistors are realized. Accordingly, it is another object of the present invention to provide a pixel circuit including only the n-type transistors.

Furthermore, depending on the manufacturing process of the organic EL device, the cathode of an organic EL device may need to be commonly connected to a plurality of pixel circuits. Accordingly, it is another object of the present invention to commonly connect the cathode of the organic EL device to a plurality of pixel circuits.

Furthermore, when some of the transistors in a pixel circuit are amorphous silicon transistors, the threshold voltage of the amorphous silicon transistors may shift, depending on the conditions of the pixel circuit. Accordingly, it is another object of the present invention to provide a function of returning the shift in the threshold voltage of the amorphous silicon transistors in a pixel circuit to the original state.

The invention can provide, in its first aspect, an electro-optical apparatus that is driven by an active-matrix driving method. The electro-optical apparatus can include a unit-circuit matrix having a plurality of unit circuits arranged in a matrix form, each unit circuit including a light-emitting device having an anode and a cathode and a circuit for adjusting a gradation of light emitted from the light-emitting device, a plurality of gate lines, each being connected to a unit-circuit group arranged in the line direction of the unit-circuit matrix, and a plurality of data lines, each being connected to a unit-circuit group arranged in the row direction of the unit-circuit matrix. The gradation of the light emitted from the light-emitting device can be controlled based on a current supplied to the unit circuit through the corresponding data line. All transistors included in the unit circuit are the same-type transistors.

With this structure, a current can be used as a data signal supplied to the unit circuit and an organic EL device, which serves as the light-emitting device, can be more precisely controlled. Furthermore, all of the transistors included in the unit circuit are the same-type transistors, so that simplification of the manufacturing process and improvement in the production yield can be expected, compared with a case where transistors having different types are combined.

It is preferable, in the electro-optical apparatus described above, that all the multiple transistors included in the unit circuit are n-type transistors. With this structure, the present invention can be applied to a manufacturing process that can use only n-type transistors. This reduces the constraints in the manufacturing process of the transistors, thus anticipating reduction in the manufacturing cost.

It is preferable, in the electro-optical apparatus described above, that the cathode of the light-emitting device be commonly connected to the plurality of unit circuits. With this structure, the present invention can be applied to a manufacturing process in which the cathode of the organic EL device must be commonly connected. Hence, the constraints in the manufacturing process of the organic EL device can be reduced, thus anticipating reduction in the manufacturing cost.

The electro-optical apparatus of the present invention further includes a characteristic-adjustment circuit having a function of switching an operation state of at least one transistor included in the unit circuit.

It is preferable, in the electro-optical apparatus described above, that the characteristic-adjustment circuit have a function of exchanging the source of a predetermined transistor included in the unit circuit with the drain thereof. With this structure, when the unit circuit includes an amorphous silicon transistor, it is possible to return a shift in the threshold voltage of the amorphous silicon transistor to the original state.

According to the electro-optical apparatus of the invention, the characteristic-adjustment circuit includes a voltage clamp circuit. The voltage clamp circuit has a function of clamping the voltage of at least one of the gate, source, or drain of the predetermined transistor included in the unit circuit to a predetermined voltage. With this structure, when the unit circuit includes an amorphous silicon transistor, it is possible to return the shift in the threshold voltage of the amorphous silicon transistor to the original state.

It is preferable, in the electro-optical apparatus described above, that the characteristic-adjustment circuit include a voltage clamp circuit and that the voltage clamp circuit have a function of setting the voltage at the gate of the predetermined transistor included in the unit circuit to a voltage that is lower than the voltage at the source of the transistor. With this structure, when the unit circuit includes an amorphous silicon transistor, it is possible to return the shift in the threshold voltage of the amorphous silicon transistor to the original state.

It is preferable, in the electro-optical apparatus described above, that the unit circuit include an amorphous silicon transistor and that the characteristic-adjustment circuit have a function of exchanging the source of the amorphous silicon transistor with the drain thereof. With this structure, it is possible to return the shift in the threshold voltage of the amorphous silicon transistor to the original state.

It is preferable, in the electro-optical apparatus described above, that the unit circuit include an amorphous silicon transistor and that the voltage clamp circuit have a function of clamping the voltage of at least one of the gate, source, or drain of the amorphous silicon transistor to a predetermined voltage. With this structure, it is also possible to return the shift in the threshold voltage of the amorphous silicon transistor to the original state.

It is preferable, in the electro-optical apparatus described above, that the unit circuit include an amorphous silicon transistor and that the voltage clamp circuit have a function of setting the voltage at the gate of the amorphous silicon transistor to a voltage that is lower than the voltage at the source of the amorphous silicon transistor. With this structure, it is also possible to return the shift in the threshold voltage of the amorphous silicon transistor to the original state.

According to the electro-optical apparatus of the invention, the unit circuit includes a current-blocking unit for blocking the current path of the light-emitting device, and the unit circuit has a function of setting the current-blocking unit to an active state during at least part of a period during which a current is supplied to the unit circuit through the corresponding data line. With this structure, it is possible to omit the organic EL device from the current path during a period when a current is supplied to the unit circuit through the corresponding data line, that is, during a period when a current flows through the current path. Omitting the organic EL device having a high parasitic resistance from the current path can shorten the time required for the operation in which a current is supplied to the unit circuit.

According to the electro-optical apparatus of the invention, the unit circuit includes a short-circuiting unit for connecting the anode of the light-emitting device to the cathode thereof, and the unit circuit has a function of setting the short-circuiting unit to an active state during at least part of a period during which a current is supplied to the unit circuit through the corresponding data line. With this structure, a resistance in the current path can be decreased during the period when a current flows through the current path, thus shortening the time required for the operation in which a current is supplied to the unit circuit.

The present invention can provide, in its second aspect, a method of driving an electro-optical apparatus by an active-matrix driving method. The electro-optical apparatus includes a unit-circuit matrix having a plurality of unit circuits arranged in a matrix form, each unit circuit including a light-emitting device having an anode and a cathode and a circuit for adjusting a gradation of light emitted from the light-emitting device, a plurality of gate lines, each being connected to a unit-circuit group arranged in the line direction of the unit-circuit matrix, and a plurality of data lines, each being connected to a unit-circuit group arranged in the row direction of the unit-circuit matrix. All transistors included in the unit circuit are the same-type transistors. The gradation of the light emitted from the light-emitting device is controlled based on a current supplied to the unit circuit through the corresponding data line.

With this structure, a current can be used as a data signal supplied to the unit circuit and an organic EL device, which serves as the light-emitting device, can be more precisely controlled. Furthermore, all of the transistors included in the unit circuit are the same-type transistors, so that simplification of the manufacturing process and improvement in the production yield can be expected, compared with a case where transistors having different types are combined.

According to the method of driving an electro-optical apparatus of the present invention, the electro-optical apparatus further includes a characteristic-adjustment circuit. The characteristic-adjustment circuit switches an operation state of at least one transistor included in the unit circuit.

It is preferable, in the method of driving an electro-optical apparatus described above, that the characteristic-adjustment circuit exchange the source of a predetermined transistor included in the unit circuit with the drain thereof. With this structure, when the unit circuit includes an amorphous silicon transistor, it is possible to return a shift in the threshold voltage of the amorphous silicon transistor to the original state.

It is also preferable, in the method of driving an electro-optical apparatus described above, that the characteristic-adjustment circuit include a voltage clamp circuit and that the voltage clamp circuit clamp the voltage of at least one of the gate, source, or drain of the predetermined transistor included in the unit circuit to a predetermined voltage. With this structure, when the unit circuit includes an amorphous silicon transistor, it is possible to return the shift in the threshold voltage of the amorphous silicon transistor to the original state.

It is preferable, in the method of driving an electro-optical apparatus described above, that the characteristic-adjustment circuit include a voltage clamp circuit and that the voltage clamp circuit set the voltage at the gate of the predetermined transistor included in the unit circuit to a voltage that is lower than the voltage at the source of the transistor. With this structure, when the unit circuit includes an amorphous silicon transistor, it is possible to return the shift in the threshold voltage of the amorphous silicon transistor to the original state.

It is preferable, in the method of driving an electro-optical apparatus described above, that the unit circuit include an amorphous silicon transistor and that the characteristic-adjustment circuit exchange the source of the amorphous silicon transistor with the drain thereof. With this structure, it is possible to return the shift in the threshold voltage of the amorphous silicon transistor to the original state.

It is preferable, in the method of driving an electro-optical apparatus described above, that the unit circuit include an amorphous silicon transistor and that the voltage clamp circuit clamp the voltage of at least one of the gate, source, or drain of the amorphous silicon transistor to a predetermined voltage. With this structure, it is also possible to return the shift in the threshold voltage of the amorphous silicon transistor to the original state.

It is preferable, in the method of driving an electro-optical apparatus described above, that the unit circuit include an amorphous silicon transistor and that the voltage clamp circuit set the voltage at the gate of the amorphous silicon transistor to a voltage that is lower than the voltage at the source of the amorphous silicon transistor. With this structure, it is also possible to return the shift in the threshold voltage of the amorphous silicon transistor to the original state.

According to the method of driving an electro-optical apparatus of the present invention, the unit circuit includes a current-blocking unit for blocking the current path of the light-emitting device, and the unit circuit sets the current-blocking unit to an active state during at least part of a period during which a current is supplied to the unit circuit through the corresponding data line. With this structure, it is possible to omit the organic EL device from the current path during a period when a current flows through the current path. Omitting the organic EL device having a high parasitic resistance from the current path can shorten the time required for the operation in which a current is supplied to the unit circuit.

According to the method of driving an electro-optical apparatus of the invention, the unit circuit can include a short-circuiting unit for connecting the anode of the light-emitting device to the cathode thereof, and the unit circuit sets the short-circuiting unit to an active state during at least part of a period during which a current is supplied to the unit circuit through the corresponding data line. With this structure, a resistance in the current path can be decreased during the period when a current flows through the current path, thus shortening the time required for the operation in which a current is supplied to the unit circuit.

BRIEF DESCRIPTION OF THE DRAWINGS

The invention will be described with reference to the accompanying drawings, wherein like numerals reference like elements, and wherein.

DETAILED DESCRIPTION OF PREFERRED EMBODIMENTS

Figure 1:
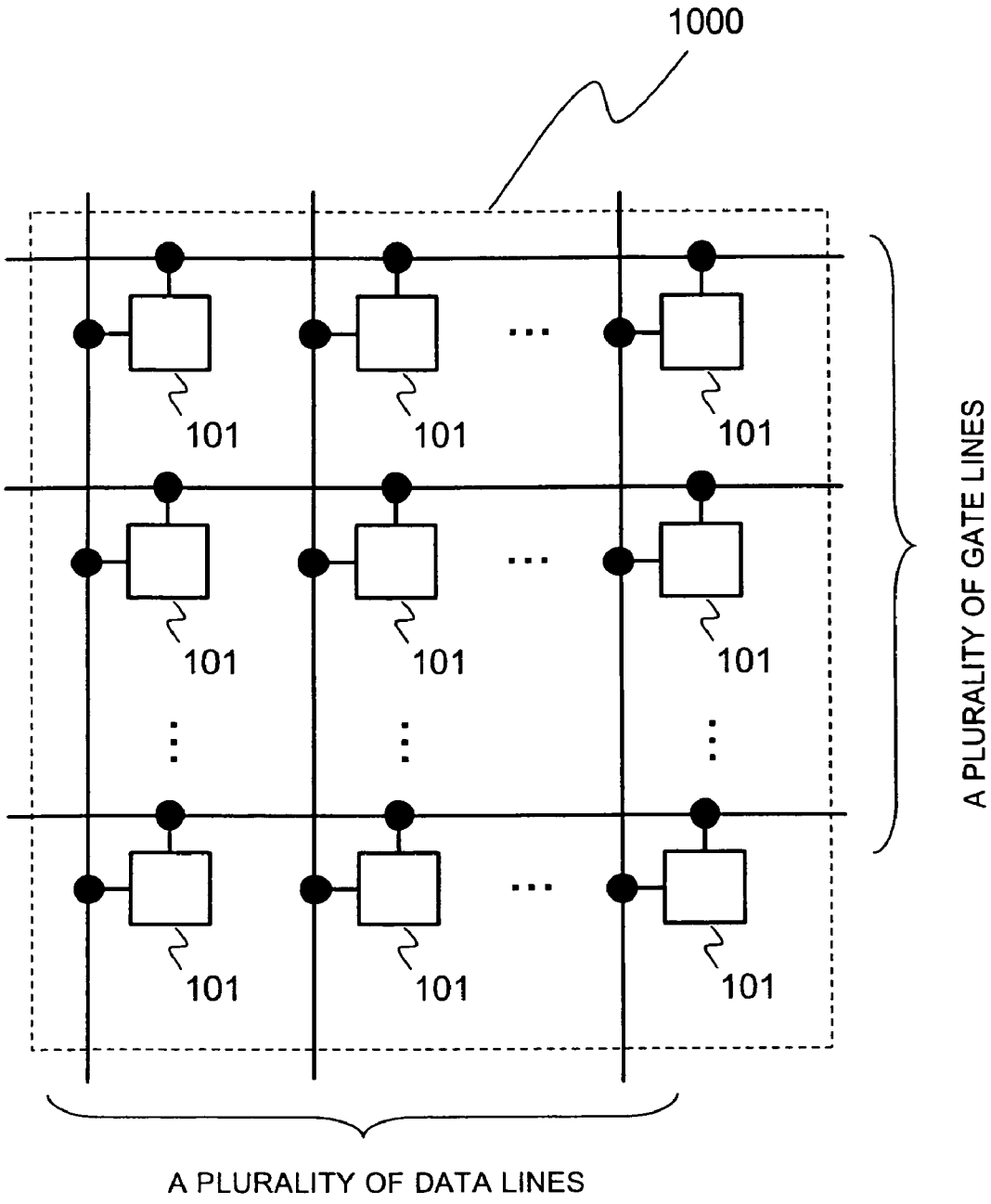
FIG. 1 is a diagram schematically showing a unit-circuit matrix according to the present invention.

Embodiments of the invention will be described below with reference to the attached drawings. FIG. 1 is a diagram schematically showing a unit-circuit matrix 1000 according to the invention. The unit-circuit matrix 1000 can include a plurality of unit circuits 101 arranged in a matrix form. A plurality of data lines extending in the row direction and a plurality of gate lines extending in the line direction that are connected to the unit-circuit matrix 1000.

Figure 2A:
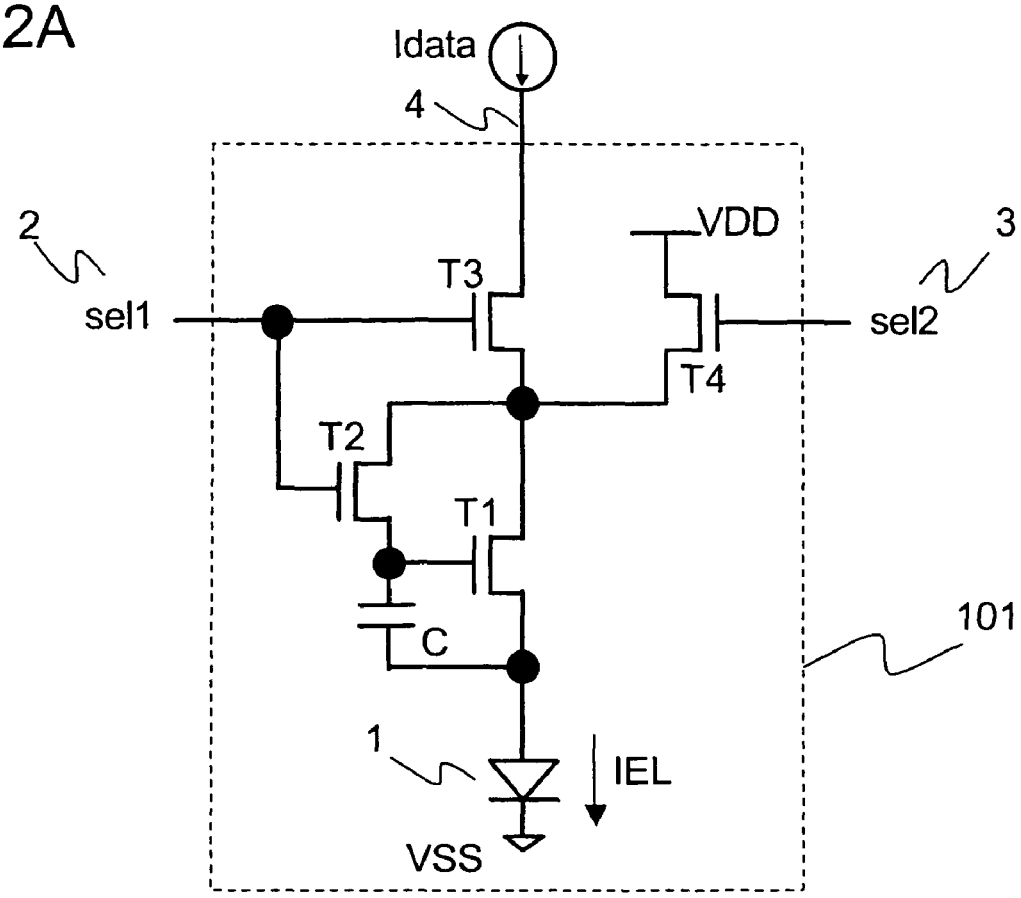
FIG. 2 includes a circuit diagram showing the structure of a pixel circuit according to a first embodiment of the present invention and a timing chart showing the operation of the pixel circuit.
Figure 2B:
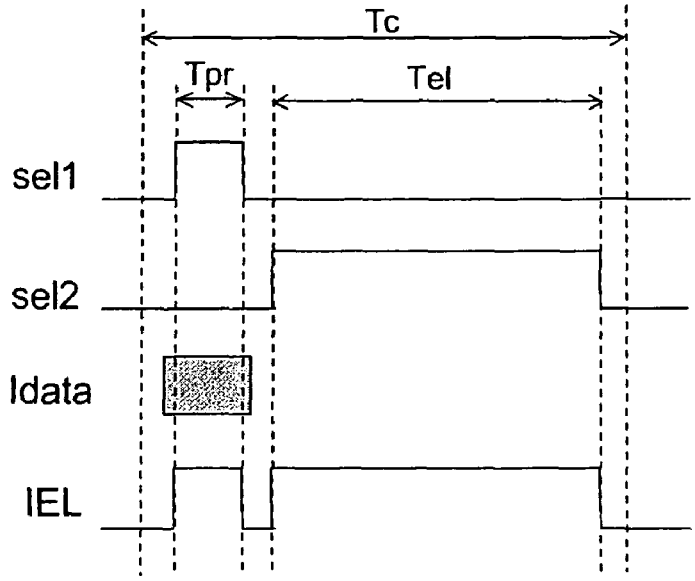

FIG. 2(*a*) is an exemplary circuit diagram showing the structure of a unit circuit or a pixel circuit 101 included in an electro-optical apparatus according to a first embodiment of the present invention. The pixel circuit 101 can be provided with an organic electroluminescent (EL) device 1, which is a light-emitting device having an anode and a cathode, first to fourth transistors T1, T2, T3, and T4 for adjusting the gradation of light emitted from the organic EL device 1, a gate line connected to the pixel circuit 101 in the line direction, and a data line 4 connected to the pixel circuit 101 in the row direction. The pixel circuit 101 further includes a data-holding capacitor C for holding the data between the gate and the source of the transistor T1 in accordance with a current supplied through the data line 4. A first sub gate-line 2 and a second sub gate-line 3 constitute the gate line.

The pixel circuit 101 is a current-programming circuit that adjusts the gradation of the organic EL device 1 in accordance with the current flowing through the data line 4. Specifically, the pixel circuit 101 can include the first transistor T1, the second transistor T2, the third transistor T3, the fourth transistor T4, and the data-holding capacitor C, in addition to the organic EL device 1. The data-holding capacitor C holds an electric charge corresponding to a data signal supplied through the data line 4 and adjusts the gradation of the light emitted from the organic EL device 1 with the electric charge. In other words, the data-holding capacitor C serves as voltage-holding device for holding a voltage corresponding to the current flowing through the data line 4. Since the organic EL device 1 is a current-injection-type (current-driven) light-emitting device like a photodiode, the organic EL device 1 is represented by the symbol for a diode.

The source of the transistor T1 is connected to the organic EL device 1. The drain of the transistor T1 is connected to a power-supply voltage VDD through the transistor T4. The drain of the transistor T2 is connected to the source of the transistor T3, the source of the transistor T4, and the drain of the transistor T1. The source of the transistor T2 is connected to the gate of the transistor T1. The data-holding capacitor C is connected between the source and the gate of the transistor T1. The drain of the transistor T3 is connected to the data line 4. The organic EL device 1 is connected between the source of the transistor T1 and a ground voltage VSS. The gates of the transistors T2 and T3 are commonly connected to the first sub gate-line 2. The gate of the transistor T4 is connected to the second sub gate-line 3.

The transistors T2 and T3 are switching transistors for use in storing the electric charge in the data-holding capacitor C. The transistor T4 is a switching transistor kept in the ON state during a light-emitting period of the organic EL device 1. The transistor T1 is a driving transistor for controlling the current flowing through the organic EL device 1. The current through the transistor T1 is controlled by the electric charge (stored electric charge) held in the data-holding capacitor C.

FIG. 2(*b*) is a timing chart showing the ordinary operation of the pixel circuit 101. A voltage sel1 of the first sub gate-line 2, a voltage sel2 of the second sub gate-line 3, a current Idata in the data line 4, and a current IEL flowing through the organic EL device 1 are shown in FIG. 2(*b*).

A driving period Tc includes a programming period Tpr and a light-emitting period Tel. The driving period Tc means a cycle during which the gradation of the light emitted from all the organic EL devices 1 in the electro-optical apparatus is updated once, and corresponds to a so-called frame period. The gradation is updated for every pixel-circuit group for one line, and the gradation is sequentially updated for the pixel-circuit groups in n lines during the driving period Tc. For example, in order to update the gradation of all the pixel circuits at 30 Hz, the driving period Tc is about 33 ms.

The programming period Tpr is a period during which the gradation of the light emitted from the organic EL device 1 is set in the pixel circuit 101. Setting the gradation in the pixel circuit 101 is called programming in this specification. For example, when the driving period Tc is about 33 ms and the total number N of gate lines is 480, the programming period Tpr is about 69 μs (=33 ms/480) or less.

During the programming period Tpr, first, a signal flowing through the second sub gate-line 3 is set to an L level to keep the transistor T4 in the OFF state (closed state). Next, a signal flowing through the first sub gate-line 2 is set to an H level while a current corresponding to the gradation flows through the data line 4, to keep the transistors T2 and T3 in the ON state (open state). The current Idata is set to a value corresponding to the gradation of the light emitted from the organic EL device 1.

An electric charge corresponding to the current Idata flowing through the transistor T1 (driving transistor) is held in the data-holding capacitor C. As a result, the voltage held in the data-holding capacitor C is applied between the gate and the source of the transistor T1. The current Idata of a data signal used for programming is called a programming current Idata in this specification.

After the programming is completed, the signal flowing through the first sub gate-line 2 is set to the L level, the transistors T2 and T3 are switched to the OFF state, and the current Idata transmitted through the data line 4 is stopped.

During the light-emitting period Tel, the signal flowing through the second sub gate-line 3 is set to the H level while the signal flowing through the first sub gate-line 2 is kept in the L level to keep the transistors T2 and T3 in the OFF state, for switching the transistor T4 to the ON state. Since a voltage corresponding to the programming current Idata is stored in advance in the data-holding capacitor C, a current that is approximately equal to the programming current Idata flows through the transistor T1. Accordingly, the current that is approximately equal to the programming current Idata also flows through the organic EL device 1, which emits the light in the gradation corresponding to the current Idata.

Figure 3A:
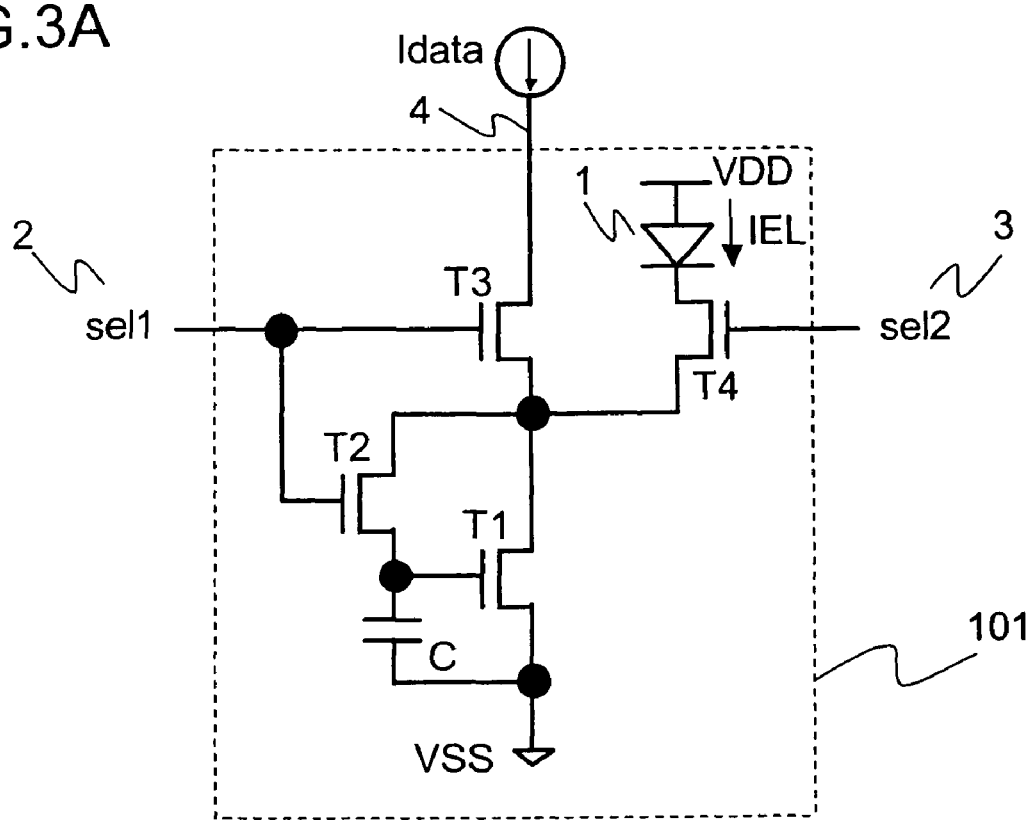
FIG. 3 includes a circuit diagram showing the structure of a pixel circuit according to a first modification of the first embodiment of the present invention and a timing chart showing the operation of the pixel circuit.
Figure 3B:
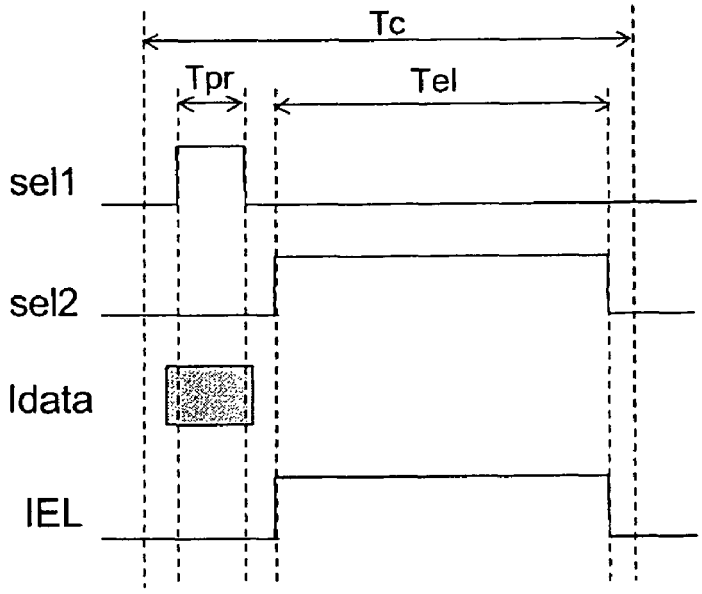

FIG. 3(*a*) is an exemplary circuit diagram showing the structure of a pixel circuit according to a first modification of the first embodiment. Referring to FIG. 3(*a*), the source of the transistor T1 is connected to the ground voltage VSS. The drain of the transistor T1 is connected to the organic EL device 1 through the transistor T4. The drain of the transistor T2 is connected to the source of the transistor T3, to the source of the transistor T4, and to the drain of the transistor T1. The source of the transistor T2 is connected to the gate of the transistor T1. The data-holding capacitor C is connected between the source and the gate of the transistor T1. The drain of the transistor T3 is connected to the data line 4. The organic EL device 1 is connected between the drain of the transistor T4 and the power-supply voltage VDD. The gates of the transistors T2 and T3 are commonly connected to the first sub gate-line 2. The gate of the transistor T4 is connected to the second sub gate-line 3.

The transistors T2 and T3 are switching transistors for use in storing the electric charge in the data-holding capacitor C. The transistor T4 is a switching transistor kept in the ON state during the light-emitting period of the organic EL device 1 and also functions as current-blocking unit for blocking the current path of the organic EL device 1 during the programming period Tpr. The transistor T1 is a driving transistor for controlling the current flowing through the organic EL device 1. The current through the transistor T1 is controlled by the electric charge (stored electric charge) held in the data-holding capacitor C.

FIG. 3(*b*) is a timing chart showing the operation of the pixel circuit 101 in FIG. 3(*a*). Since the principle of operation is the same as in the pixel circuit 101 shown in FIG. 2(*a*), a detailed description is omitted here. The pixel circuit 101 in FIG. 3(*a*) differs from the pixel circuit 101 in FIG. 2(*a*) in that the organic EL device 1 is not included in the current path of the current Idata during the programming period Tpr. This non-inclusion has an effect of relieving the driving load of the current Idata.

Figure 11A:
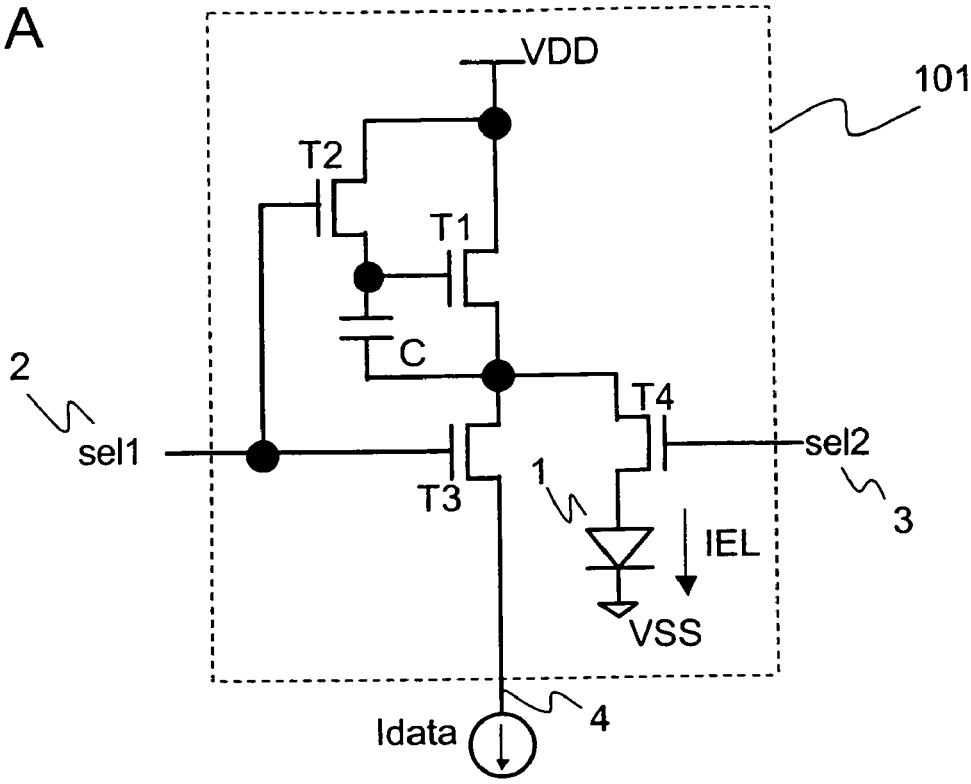
FIG. 11 includes a circuit diagram showing the structure of a pixel circuit according to a second modification of the first embodiment of the present invention and a timing chart showing the operation of the pixel circuit.
Figure 11B:
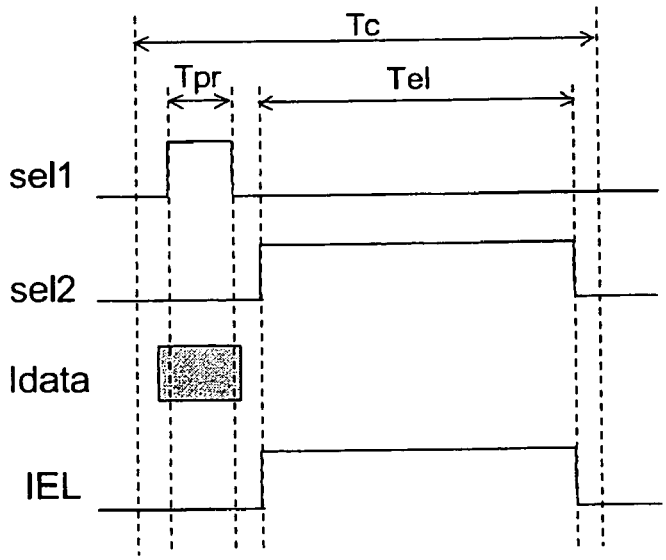

FIG. 11(*a*) is an exemplary circuit diagram showing the structure of a pixel circuit according to a second modification of the first embodiment. Referring to FIG. 11(*a*), the drain of the transistor T1 is connected to the power-supply voltage VDD. The source of the transistor T1 is connected to the drain of the transistor T3 and to the drain of the transistor T4. The drain of the transistor T2 is connected to the power-supply voltage VDD. The source of the transistor T2 is connected to the gate of the transistor T1. The data-holding capacitor C is connected between the source and the gate of the transistor T1. The source of the transistor T3 is connected to the data line 4. The organic EL device 1 is connected between the source of the transistor T4 and the ground voltage VSS. The gates of the transistors T2 and T3 are commonly connected to the first sub gate-line 2. The gate of the transistor T4 is connected to the second sub gate-line 3.

The transistors T2 and T3 are switching transistors for use in storing the electric charge in the data-holding capacitor C. The transistor T4 is a switching transistor kept in the ON state during the light-emitting period of the organic EL device 1, and also functions as current-blocking unit for blocking the current path of the organic EL device 1 during the programming period Tpr. The transistor T1 is a driving transistor for controlling the current flowing through the organic EL device 1. The current through the transistor T1 is controlled by the electric charge (stored electric charge) held in the data-holding capacitor C.

FIG. 11(*b*) is a timing chart showing the operation of the pixel circuit 101 in FIG. 11(*a*). Since the principle of operation is the same as in the pixel circuit 101 shown in FIG. 2(*a*), a detailed description is omitted here. The pixel circuit 101 in FIG. 11(*a*) differs from the pixel circuit 101 in FIG. 2(*a*) in that the organic EL device 1 is not included in the current path of the current Idata during the programming period Tpr. This non-inclusion has an effect of relieving the driving load of the current Idata.

Figure 15A:
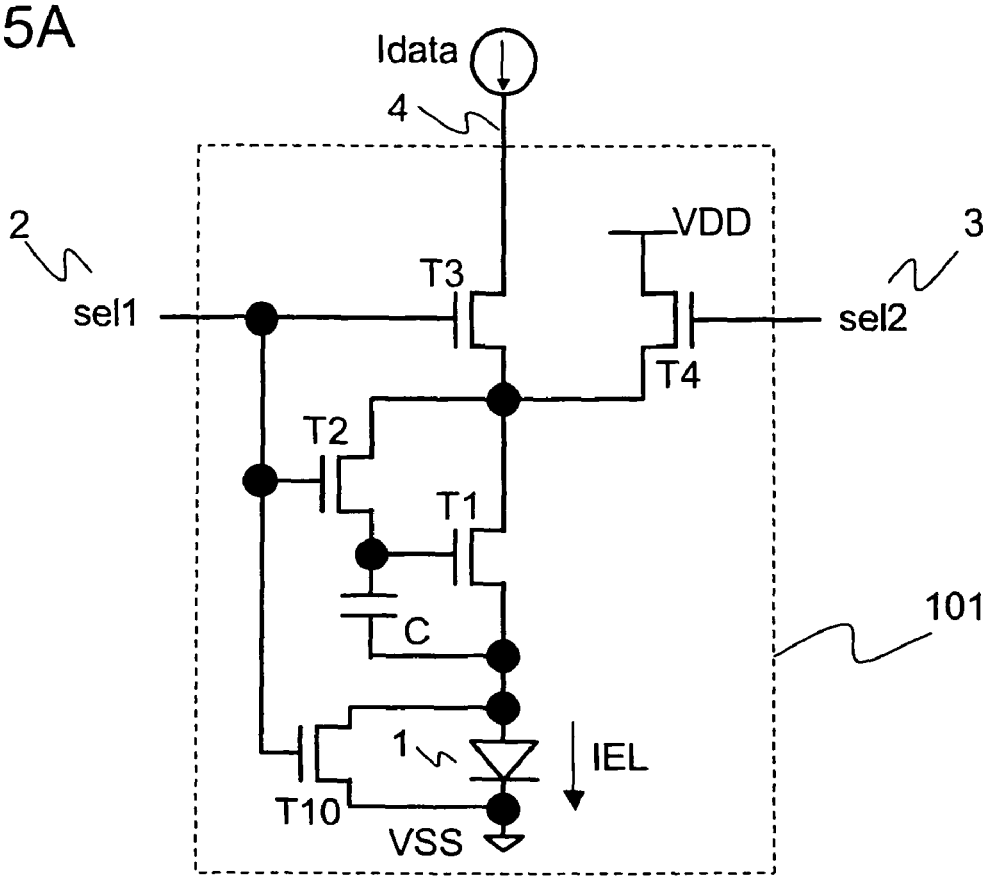
FIG. 15 includes a circuit diagram showing the structure of a pixel circuit according to a third modification of the first embodiment of the present invention and a timing chart showing the operation of the pixel circuit.
Figure 15B:
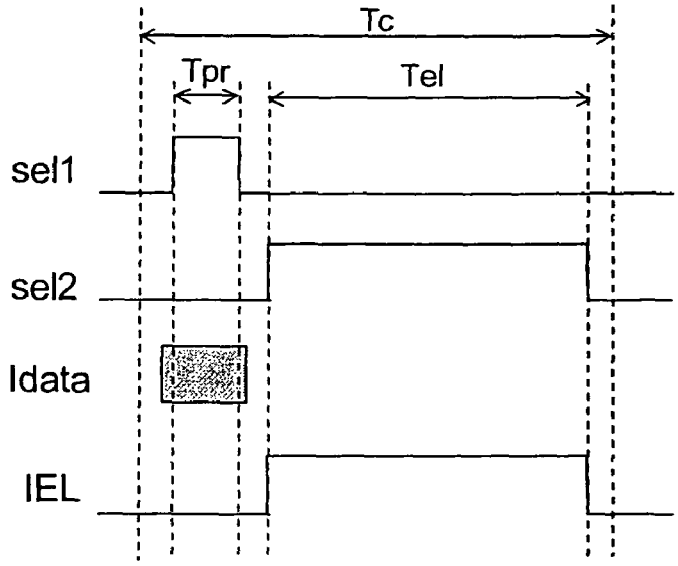

FIG. 15(*a*) is an exemplary circuit diagram showing the structure of a pixel circuit according to a third modification of the first embodiment. Referring to FIG. 15(*a*), the source of the transistor T1 is connected to the organic EL device 1. The drain of the transistor T1 is connected to the power-supply voltage VDD through the transistor T4. The drain of the transistor T2 is connected to the source of the transistor T3, to the source of the transistor T4, and to the drain of the transistor T1. The source of the transistor T2 is connected to the gate of the transistor T1. The drain of a transistor T10 is connected to the source of the transistor T1 and to the anode of the organic EL device 1. The source of the transistor T10 is connected to the cathode of the organic EL device 1 and to the ground voltage VSS. The data-holding capacitor C is connected between the source and the gate of the transistor T1. The drain of the transistor T3 is connected to the data line 4. The organic EL device 1 is connected between the source of the transistor T1 and the ground voltage VSS. The gates of the transistors T2, T3 and T10 are commonly connected to the first sub gate-line 2. The gate of the transistor T4 is connected to the second sub gate-line 3.

The transistors T2 and T3 are switching transistors for use in storing the electric charge in the data-holding capacitor C. The transistor T4 is a switching transistor kept in the ON state during the light-emitting period of the organic EL device 1. The transistor T1 is a driving transistor for controlling the current flowing through the organic EL device 1. The current through the transistor T1 is controlled by the electric charge (stored electric charge) held in the data-holding capacitor C. The transistor T10 functions as short-circuiting unit for short-circuiting the anode and the cathode of the organic EL device 1 during the programming period Tpr.

FIG. 15(*b*) is a timing chart showing the operation of the pixel circuit 101 in FIG. 15(*a*). Since the principle of operation is the same as in the pixel circuit 101 shown in FIG. 2(*a*), a detailed description is omitted here. Since the transistor T10 is switched to the ON state during the programming period Tpr in the pixel circuit 101 in FIG. 15(*a*), the anode and the cathode of the organic EL device 1 are short-circuited. Accordingly, the sum of the resistance in the current path of the current Idata is smaller than that in the pixel circuit 101 in FIG. 2(*a*), thus relieving the driving load of the current Idata.

The pixel circuits 101 shown in FIGS. 2(*a*), 3(*a*), 11(*a*), and 15(*a*) use the programming current Idata as the data signal, and all the transistors in each of the pixel circuits 101 have the same polarity. Hence, it is possible to achieve high-precision control of the organic EL device 1, and to anticipate simplification of the manufacturing process and improvement in the production yield, compared with a case where transistors having different polarities are combined.

All the transistors in each of the pixel circuits 101 shown in FIGS. 2(*a*), 3(*a*), 11(*a*), and 15(*a*) have a negative polarity (N-type transistors). Hence, these pixel circuits 101 can be realized even in a manufacturing process that can use only the N-type transistors. This reduces the constraints in the manufacturing process of the transistors, thus anticipating reduction in the manufacturing cost.

Referring to FIGS. 2(*a*), 11(*a*), and 15(*a*), the cathode of the organic EL device 1 in the pixel circuit 101 is commonly connected between a plurality of pixel circuits 101. Hence, the pixel circuit 101 can be realized even in a manufacturing process in which the cathode must be commonly used, during the manufacture of the organic EL device 1. This reduces the constraints in the manufacturing process of the organic EL device, and thus a reduction in manufacturing costs can be expected. Each of the pixel circuits 101 shown in FIGS. 3(*a*) and 11(*a*) is structured so as not to include the organic EL device 1 in the current path of the current Idata during the programming period Tpr. Generally, the organic EL device 1 has a predetermined resistance, which is sometimes much higher than the on-resistance of the transistor. Since each of the pixel circuits 101 shown in FIGS. 3(*a*) and 11(*a*) does not include the organic EL device 1 in the current path of the current Idata, the sum of the resistance in the current path can be decreased. The same applies to the pixel circuit 101 in FIG. 15(*a*). With these pixel circuits, the voltage applied to the opposing ends of the current path of the current Idata can be reduced. At the same time, the time required for programming the current Idata can be shortened.

Figure 4A:
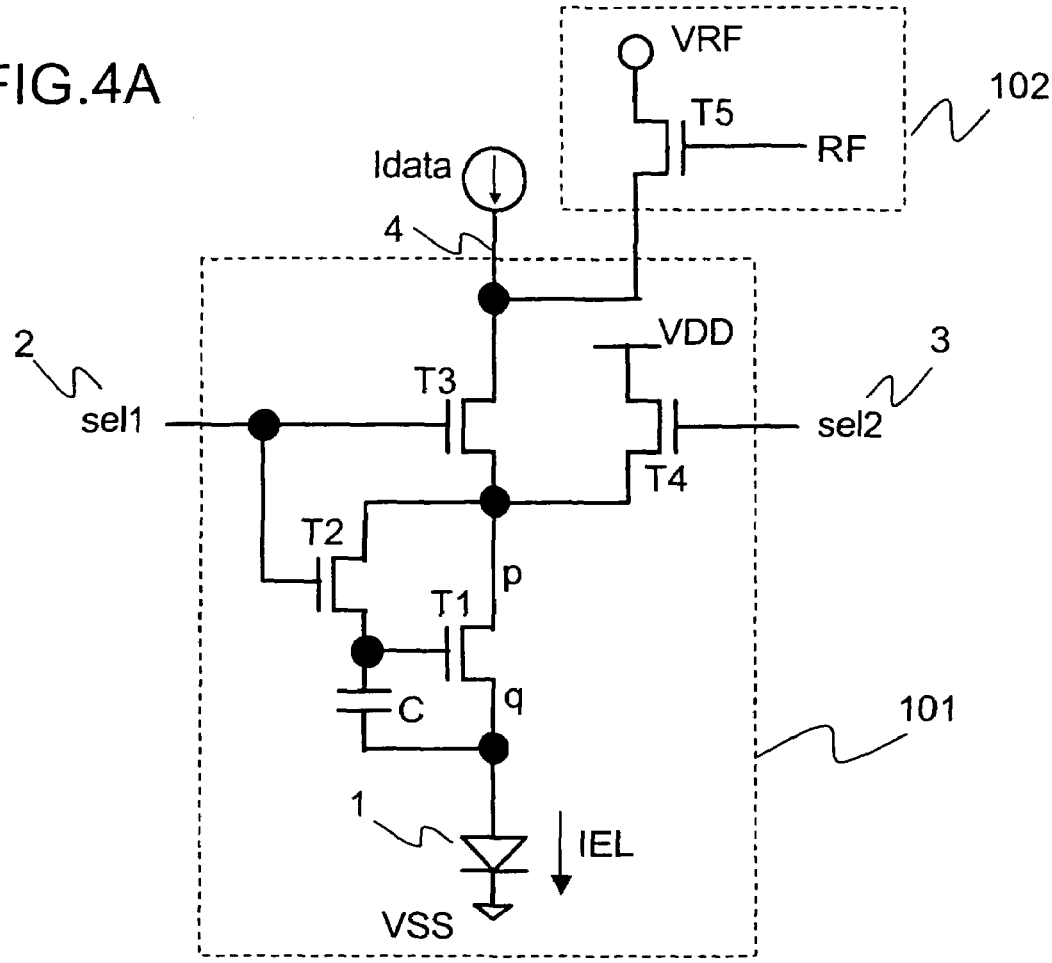
FIG. 4 includes a circuit diagram showing the structure of a pixel circuit according to a second embodiment of the present invention and a timing chart showing the operation of the pixel circuit.
Figure 4B:
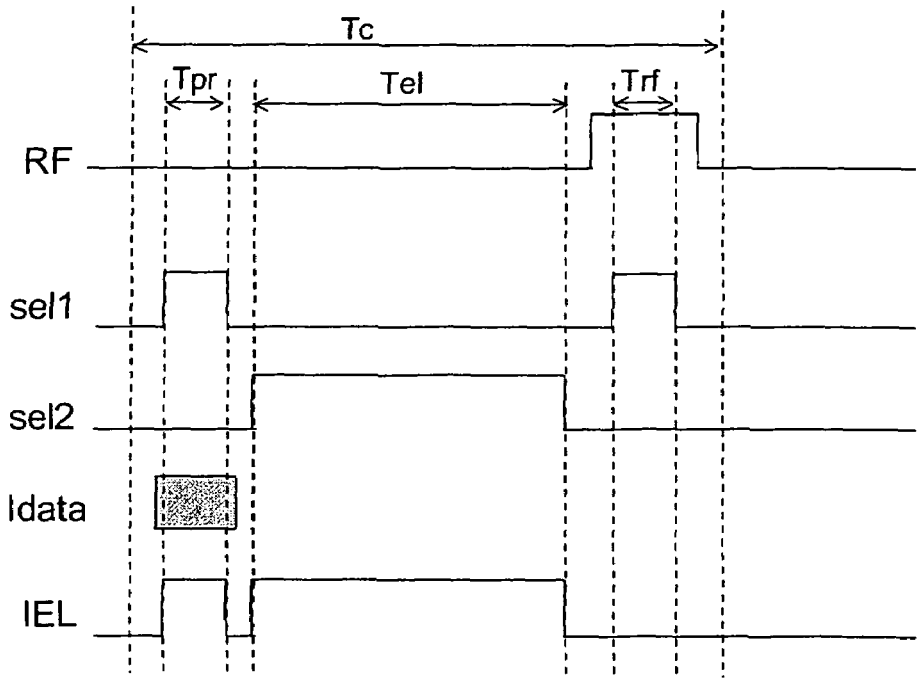

FIG. 4(*a*) is an exemplary circuit diagram showing the structure of a pixel circuit 101 and a characteristic-adjustment circuit 102 included in an electro-optical apparatus according to a second embodiment of the present invention. The pixel circuit 101 in FIG. 4(*a*) has the same structure as in the first embodiment shown in FIG. 2(*a*).

The characteristic-adjustment circuit 102 functions for at least the transistor T1 among the transistors included in the pixel circuit 101. The characteristic-adjustment circuit 102 includes a power-supply voltage VRF, an N-type fifth transistor T5 functioning as a switch, and a signal RF for turning on and off the fifth transistor T5. The signal RF is supplied to the gate of the fifth transistor T5, the source thereof is connected to the data line 4, and the drain thereof is connected to the power-supply voltage VRF. The power-supply voltage VRF is set to a voltage that is not higher than the ground voltage VSS. The L level of the signal RF, the signal flowing through the first sub gate-line 2, and the signal flowing through the second sub gate-line 3 is set to be not higher than the power-supply voltage VRF. Accordingly, the transistors T2, T3, T4, and T5 can be reliably switched to the OFF state.

FIG. 4(*b*) is a timing chart showing the operation of the pixel circuit 101 in FIG. 4(*a*). A voltage sel1 of the first sub gate-line 2, a voltage sel2 of the second sub gate-line 3, a current Idata in the data line 4, a current IEL flowing through the organic EL device 1, and the voltage of the signal RF are shown in FIG. 4(*b*).

A driving period Tc includes a programming period Tpr, a light-emitting period Tel, and an adjusting period Trf. While the driving period Tc and the programming period Tpr are the same as in the first embodiment, the adjusting period Trf, during which the characteristic-adjustment circuit 102 affects the pixel circuit 101, is added.

The operation of the pixel circuit 101 shown in FIG. 4(*a*) will now be described. During the programming period Tpr, a voltage corresponding to the current Idata is stored in the data-holding capacitor C provided between the gate and the source of the transistor T1. During the light-emitting period Tel, a current that is approximately equal to the programming current Idata flows through the organic EL device 1, which emits light in gradations corresponding to the programming current Idata. Since the fifth transistor T5 is set to the OFF state during the period from the programming period Tpr to the light-emitting period Tel, the characteristic-adjustment circuit 102 does not affect the pixel circuit 101. Then, during the adjusting period Trf, the programming current Idata is stopped, all the transistors T2, T3, and T5 are switched to the ON state, and the gate of the transistor T1 is set to the power-supply voltage VRF. Since a node q in FIG. 4(*a*) is connected to the ground voltage VSS through the organic EL device 1, the node q has a voltage not lower than the ground voltage VSS. The gate of the transistor T1 and a node p is set to the power-supply voltage VRF, which is not higher than the ground voltage VSS. As a result, the transistor T1 is switched to the OFF state and, therefore, the organic EL device 1 does not emit light.

When the power-supply voltage VRF is set to a voltage not higher than the ground voltage VSS, the voltage of the node p is higher than that of the node q during the programming period Tpr and the light-emitting period Tel, whereas the voltage of the node p is lower than the voltage of the node q during the adjusting period Trf, thus inverting the relation between the voltage of the node p and that of the node q. In other words, the source of the transistor T1 is exchanged with the drain thereof. For example, when the transistor T1 in the pixel circuit 101 is an amorphous silicon transistor, continuously using the transistor T1 in a direct-current mode generally shifts the threshold voltage. Methods of preventing this shift include a method of exchanging the source of the transistor with the drain thereof and a method of periodically switching the transistor to the OFF state. According to the pixel circuit 101 shown in FIG. 4(*a*), since the source of the transistor T1 is exchanged with the drain thereof when the transistor T1 is an amorphous silicon transistor, it is possible to return the shift in the threshold voltage to the original state.

Figure 5A:
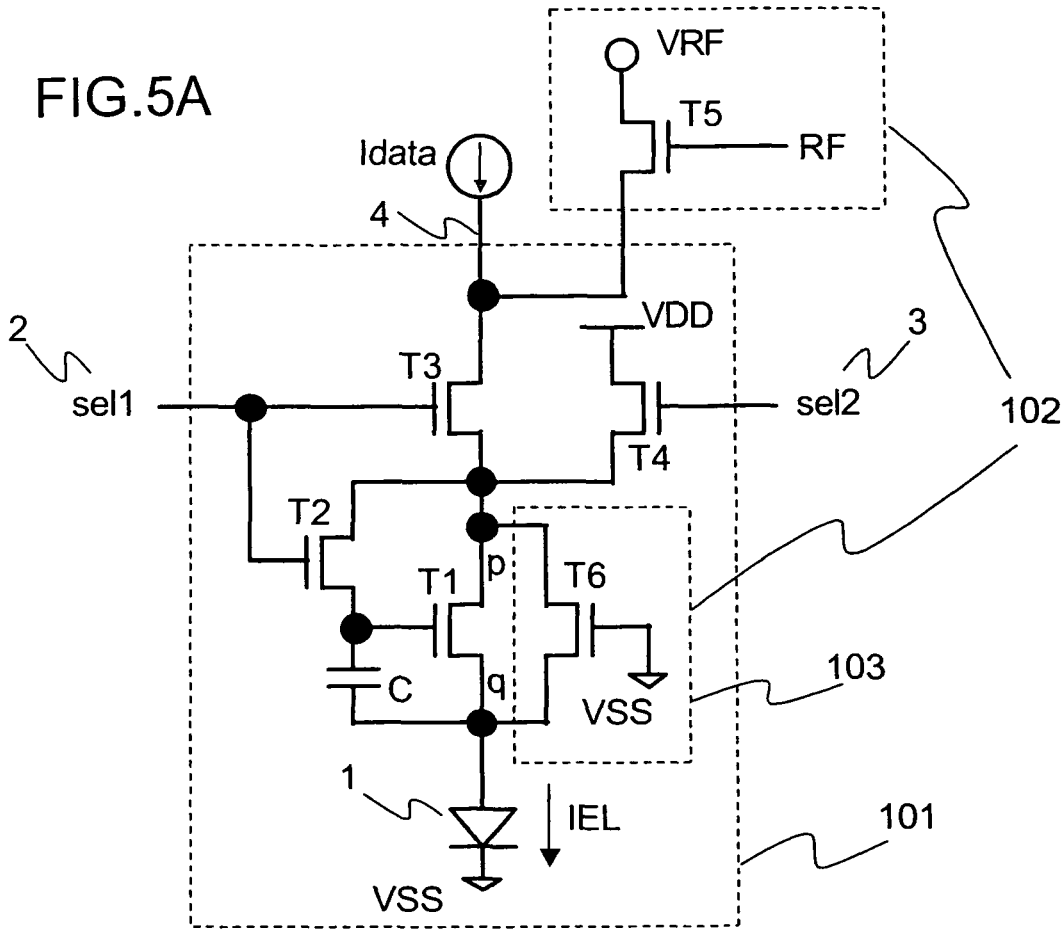
FIG. 5 includes a circuit diagram showing the structure of a pixel circuit according to a first modification of the second embodiment of the present invention and a timing chart showing the operation of the pixel circuit.
Figure 5B:
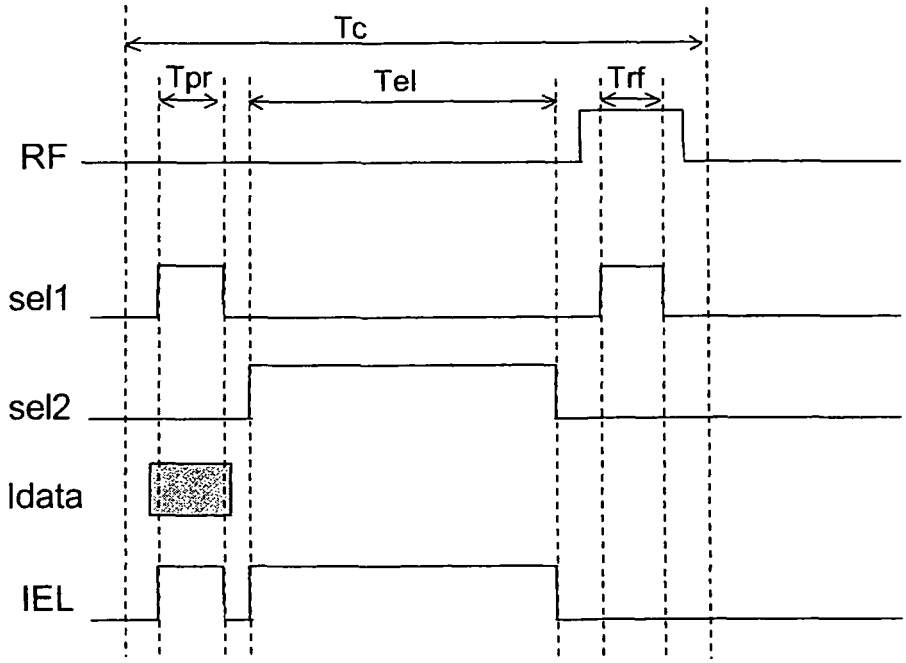

FIG. 5(*a*) is an exemplary circuit diagram showing the structure of a pixel circuit included in an electro-optical apparatus according to a first modification of the second embodiment. The pixel circuit 101 in FIG. 5(*a*) has the same structure as in the pixel circuit 101 in FIG. 4(*a*) except for a voltage clamp circuit 103.

The voltage clamp circuit 103 is a circuit for performing voltage-clamping at a predetermined node in the pixel circuit 101. The voltage clamp circuit 103 includes a transistor T6 functioning as a switch. The ground voltage VSS is applied to the gate of the transistor T6. The transistor T6 is an N-type transistor, and the source and the drain of the transistor T6 are connected to the source and the drain of the transistor T1, respectively. In the pixel circuit 101 shown in FIG. 5(*a*), the power-supply voltage VRF is set to a voltage not higher than a voltage that is lower than the ground voltage VSS by a threshold voltage Vth (T6) of the transistor T6. The L level of the signal RF, the signal flowing through the first sub gate-line 2, and the signal flowing through the second sub gate-line 3 is set to be not higher than the power-supply voltage VRF, as in the pixel circuit 101 in FIG. 4(*a*). Accordingly, the transistors T2, T3, T4, and T5 can be reliably switched to the OFF state. The voltage clamp circuit 103 is described as part of the characteristic-adjustment circuit 102 in this specification.

FIG. 5(*b*) is a timing chart showing the operation of the pixel circuit 101 in FIG. 5(*a*). A voltage sel1 of the first sub gate-line 2, a voltage sel2 of the second sub gate-line 3, a current Idata in the data line 4, a current IEL flowing through the organic EL device 1, and the voltage of the signal RF are shown in FIG. 5(*b*). As in FIG. 4(*b*), the driving period Tc includes the programming period Tpr, the light-emitting period Tel, and the adjusting period Trf. The driving period Tc and the programming period Tpr are the same as in the pixel circuit 101 in FIG. 4(*a*), whereas the operation of the adjusting period Trf is different from that in FIG. 4(*a*).

The operation of the pixel circuit 101 shown in FIG. 5(*a*) will now be described. During the programming period Tpr, a voltage corresponding to the current Idata is stored in the data-holding capacitor C provided between the gate and the source of the transistor T1. During the light-emitting period Tel, a current that is approximately equal to the programming current Idata flows through the organic EL device 1, which emits the light in gradations corresponding to the programming current Idata. Since the fifth transistor T5 is set to the OFF state during the period from the programming period Tpr to the light-emitting period Tel and the gate voltage of the transistor T6 is lower than or equal to the voltage of the node p and the node q, the transistor T6 is kept in the OFF state. Accordingly, the characteristic-adjustment circuit 102 including the voltage clamp circuit 103 does not affect the pixel circuit 101. Then, during the adjusting period Trf, the programming current Idata is stopped, all the transistors T2, T3, and T5 are switched to the ON state, and the gate of the transistor T1 is set to the power-supply voltage VRF. Since the node p in FIG. 5(*a*) is set to the power-supply voltage VRF, which is lower than or equal to a voltage given by subtracting the threshold voltage Vth (T6) from the ground voltage VSS, the transistor T6 is switched to the ON state and the node q is set to the power-supply voltage VRF. All of the gate, source, and drain of the transistor T1 are set to the power-supply voltage VRF in this state, thus switching the transistor T1 to the OFF state. Since the node q is set to the power-supply voltage VRF, which is lower than or equal to a voltage given by subtracting the threshold voltage Vth (T6) from the ground voltage VSS, the organic EL device 1 is in a reverse-biased state and, therefore, does not emit the light.

In view of the on-resistance of the transistor T6, the voltage of the node p is supposed to be lower than the voltage of the node q. Accordingly, the voltage of the node p is higher than that of the node q during the programming period Tpr and the light-emitting period Tel, whereas the voltage of the node p is lower than the voltage of the node q during the adjusting period Trf, thus inverting the relation between the voltage of the node p and that of the node q, as in the pixel circuit 101 in FIG. 4(*a*). Hence, for example, when the transistor T1 in the pixel circuit 101 is an amorphous silicon transistor, it is possible to return the shift in the threshold voltage in the transistor T1 to the original state.

The pixel circuit 101 in FIG. 5(*a*) differs from the pixel circuit 101 in FIG. 4(*a*) in that the node q is voltage-clamped to the power-supply voltage VRF. In the pixel circuit 101 in FIG. 4(*a*), since the node q is in a floating state, the voltage of the node p cannot reliably be set to be lower than the voltage of the node q with respect to the transistor T1. In contrast, in the pixel circuit 101 in FIG. 5(*a*), since the node q is set to the power-supply voltage VRF, the voltage of the node p can be reliably set to be lower than the voltage of the node q with respect to the transistor T1. Hence, when the transistor T1 is an amorphous silicon transistor, the pixel circuit 101 in FIG. 5(*a*) is highly effective for returning the shift in the threshold voltage in the transistor T1 to the original state, compared with the pixel circuit 101 in FIG. 4(*a*).

Figure 6A:
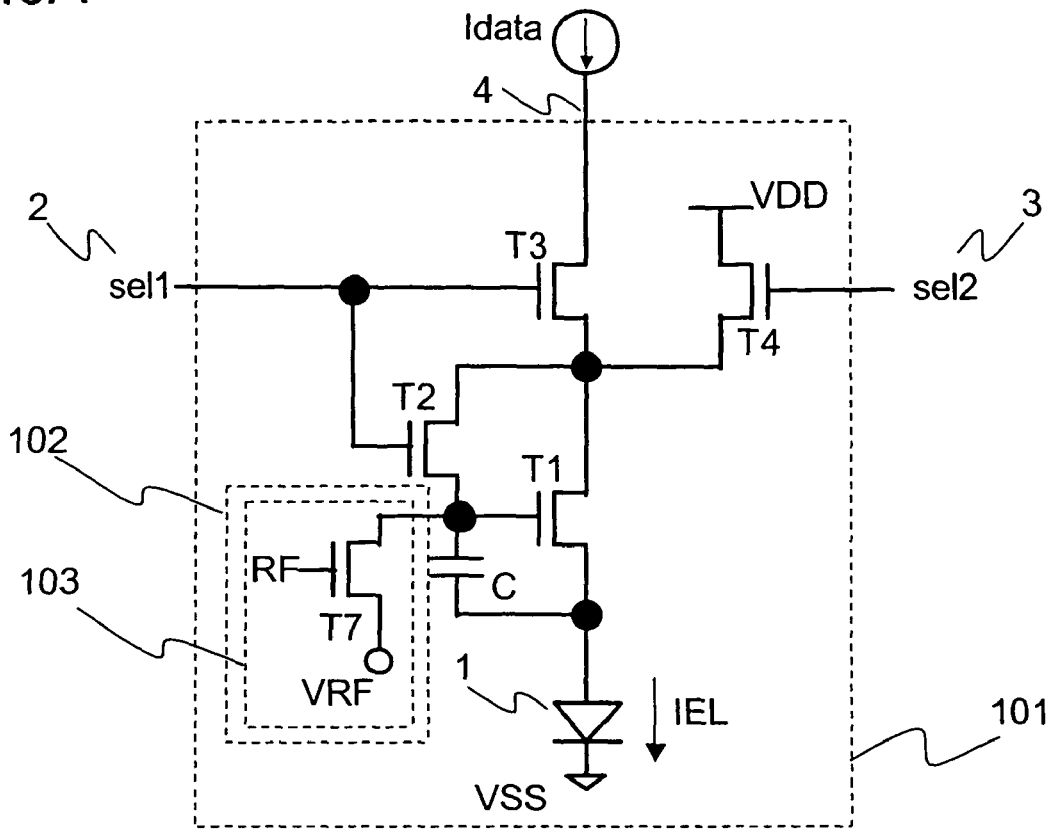
FIG. 6 includes a circuit diagram showing the structure of a pixel circuit according to a second modification of the second embodiment of the present invention and a timing chart showing the operation of the pixel circuit.
Figure 6B:
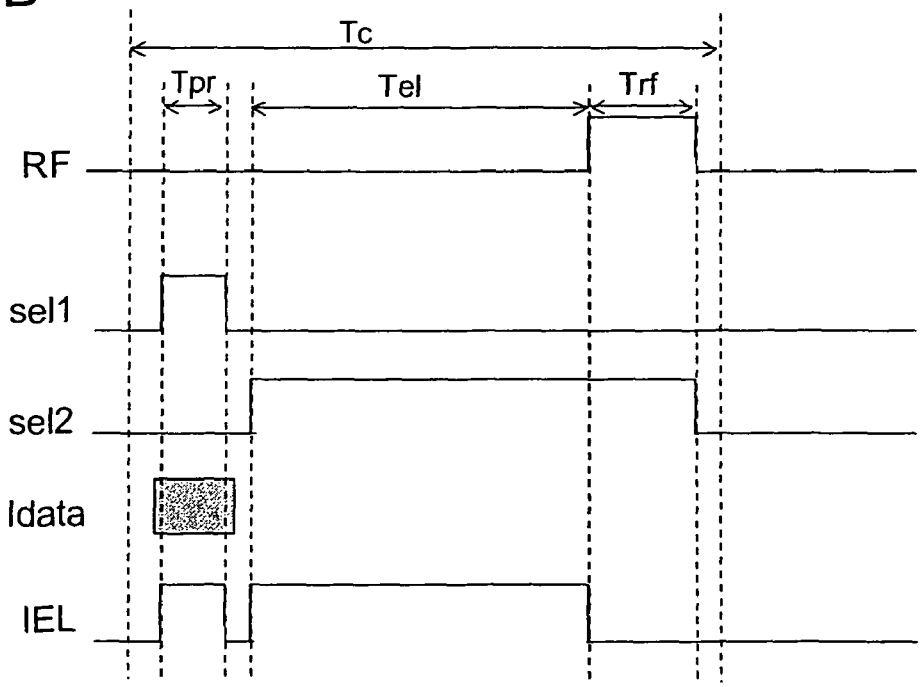

FIG. 6(*a*) is an exemplary circuit diagram showing the structure of a pixel circuit included in an electro-optical apparatus according to a second modification of the second embodiment. The structure of the characteristic-adjustment circuit 102 is altered in the pixel circuit 101 in FIG. 6(*a*), compared with the pixel circuit 101 in FIG. 4(*a*). In addition, the voltage clamp circuit 103 is used as the characteristic-adjustment circuit 102, unlike the pixel circuit 101 in FIG. 5(*a*).

The voltage clamp circuit 103 is a circuit for performing voltage-clamping at a predetermined node in the pixel circuit 101, as in the pixel circuit 101 in FIG. 5(*a*). The voltage clamp circuit 103 includes the power-supply voltage VRF, an N-type seventh transistor T7 functioning as a switch, and the signal RF for turning on and off the seventh transistor T7. The signal RF is supplied to the gate of the seventh transistor T7, the drain thereof is connected to the gate of the transistor T1, and the source thereof is connected to the power-supply voltage VRF.

FIG. 6(*b*) is a timing chart showing the operation of the pixel circuit 101 in FIG. 6(*a*). A voltage sel1 of the first sub gate-line 2, a voltage sel2 of the second sub gate-line 3, a current Idata in the data line 4, a current IEL flowing through the organic EL device 1, and the voltage of the signal RF are shown in FIG. 6(*b*). As in FIGS. 4(*b*) and 5(*b*), the driving period Tc includes the programming period Tpr, the light-emitting period Tel, and the adjusting period Trf. The driving period Tc and the programming period Tpr are the same as in the pixel circuit 101 in FIG. 4(*a*), whereas the operation of the adjusting period Trf is different from the operations of the adjusting periods Trf in FIGS. 4(*a*) and 5(*a*).

The operation of the pixel circuit 101 shown in FIG. 6(*a*) will now be described. During the programming period Tpr, a voltage corresponding to the current Idata is stored in the data-holding capacitor C provided between the gate and the source of the transistor T1. During the light-emitting period Tel, a current that is approximately equal to the programming current Idata flows through the organic EL device 1, which emits the light in gradations corresponding to the programming current Idata. Since the seventh transistor T7 is set to the OFF state during the period from the programming period Tpr to the light-emitting period Tel, the characteristic-adjustment circuit 102 does not affect the pixel circuit 101. Then, since the transistors T2 and T3 are switched to the OFF state and the seventh transistor T7 is switched to the ON state during the adjusting period Trf, the gate of the transistor T1 is set to the power-supply voltage VRF. Setting the power-supply voltage VRF to a sufficiently low voltage causes the transistor T1 to be in the OFF state and, therefore, the organic EL device 1 does not emit light.

While the transistor T1 is in the ON state during the programming period Tpr and the light-emitting period Tel, it is in the OFF state during the adjusting period Trf and, therefore, the transistor T1 is switched between the ON state and the OFF state. Hence, for example, when the transistor T1 is an amorphous silicon transistor, it is possible to return the shift in the threshold voltage in the transistor T1 to the original state. In addition, adjusting the power-supply voltage VRF can adjust the biased state of the transistor T1. For example, the shift in the threshold voltage can be effectively returned to the original state by setting the gate of the transistor T1 to a voltage lower than that of the source of the transistor T1.

Figure 7A:
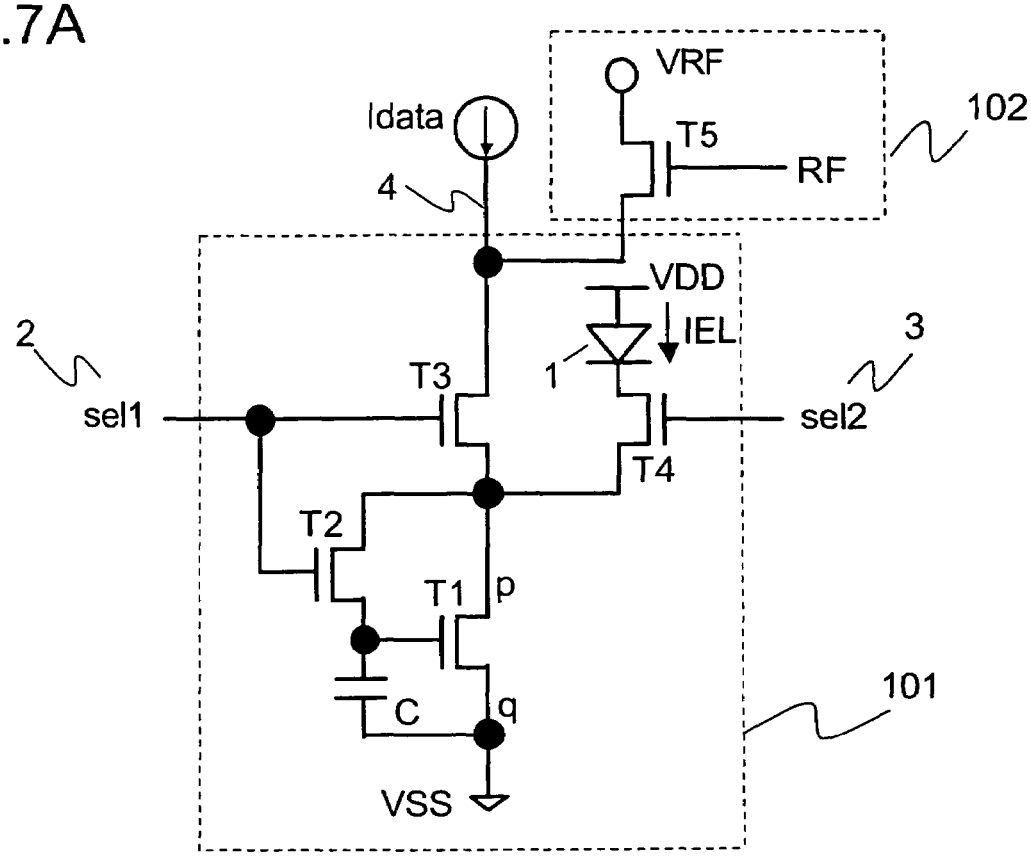
FIG. 7 includes a circuit diagram showing the structure of a pixel circuit according to another modification of the second embodiment of the present invention and a timing chart showing the operation of the pixel circuit.
Figure 7B:
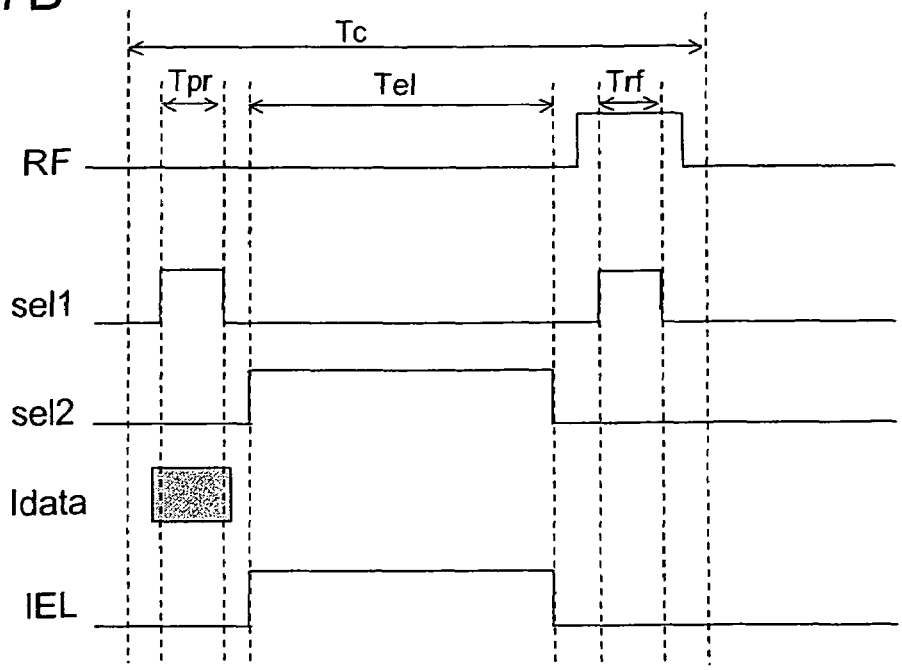
Figure 8A:
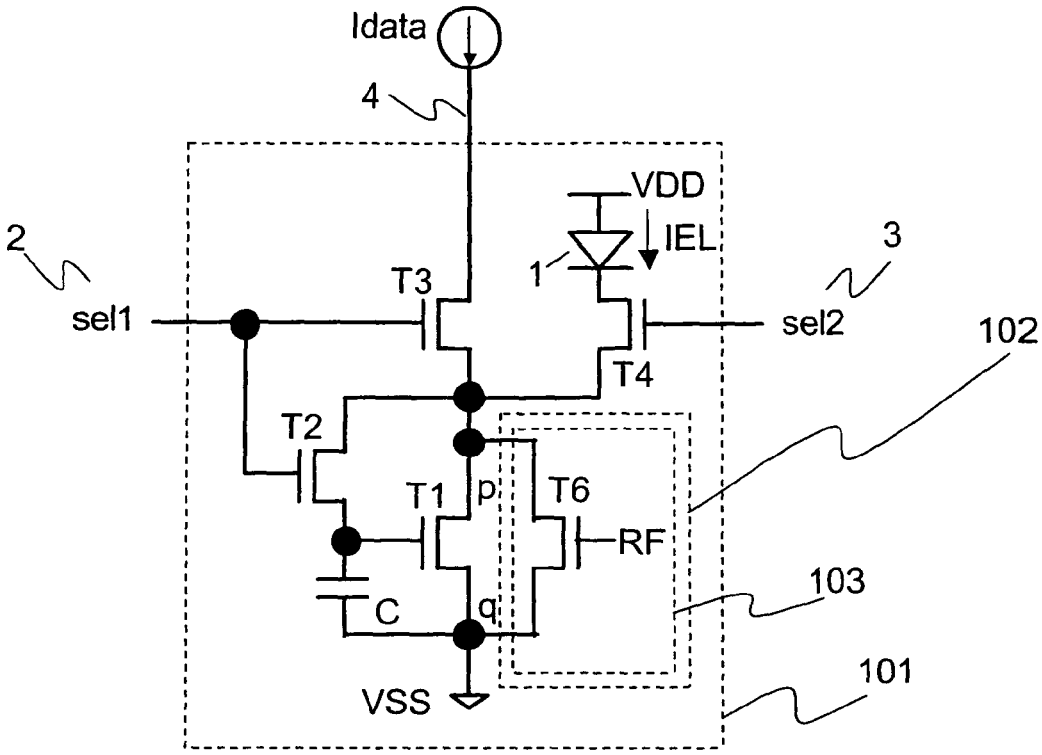
FIG. 8 includes a circuit diagram showing the structure of a pixel circuit according to another modification of the second embodiment of the present invention and a timing chart showing the operation of the pixel circuit.
Figure 8B:
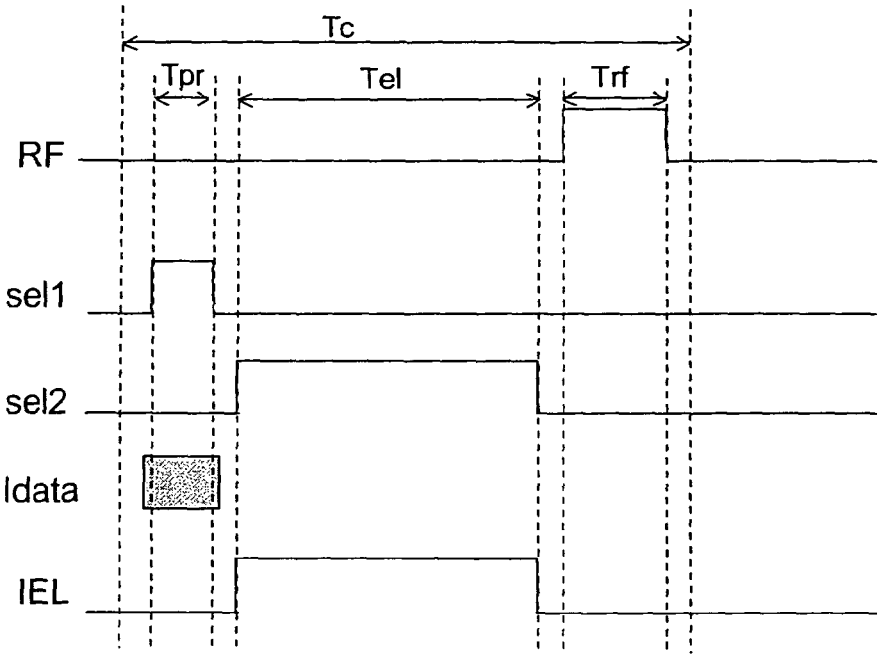
Figure 9A:
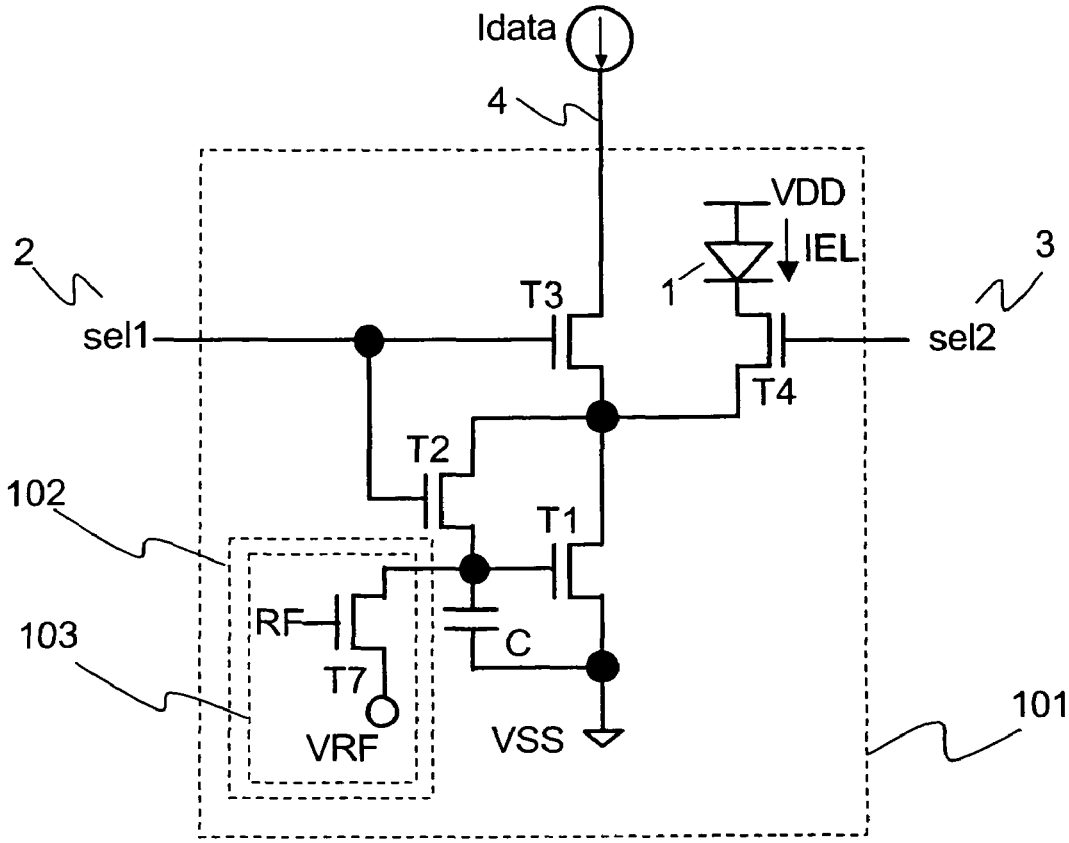
FIG. 9 includes a circuit diagram showing the structure of a pixel circuit according to another modification of the second embodiment of the present invention and a timing chart showing the operation of the pixel circuit.
Figure 9B:
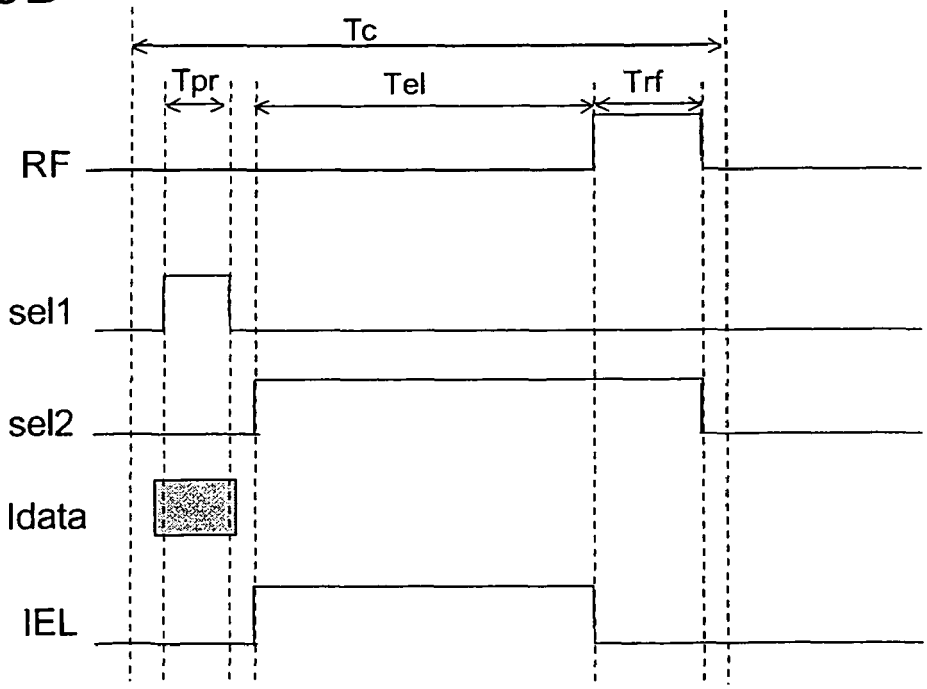
Figure 10A:
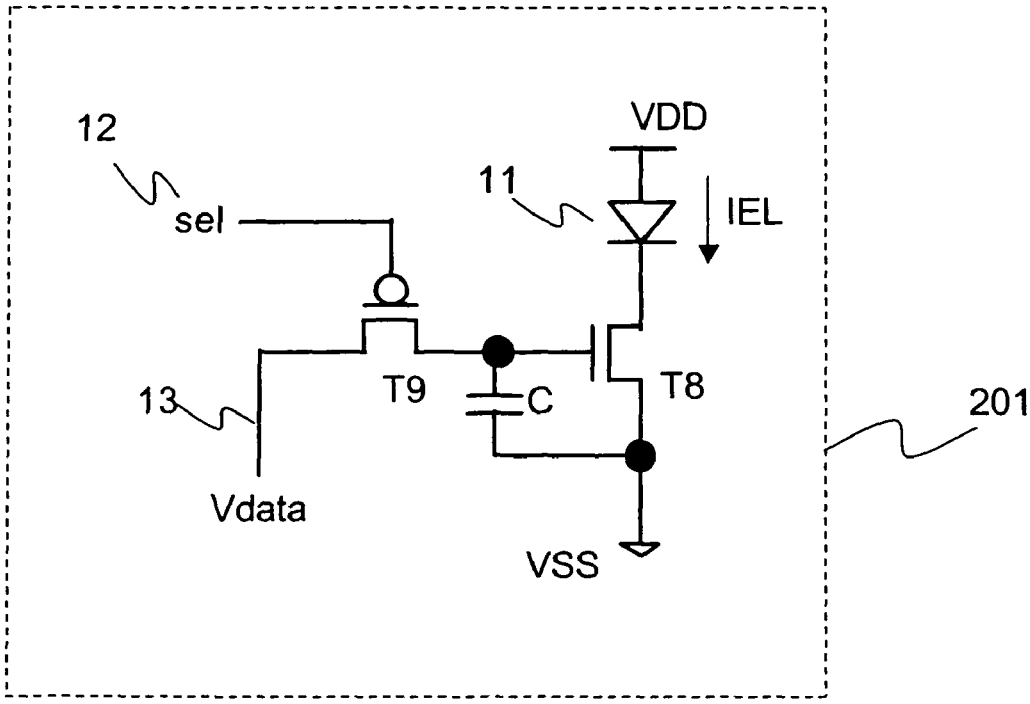
FIG. 10 includes a circuit diagram showing the structure of a known pixel circuit and a timing chart showing the operation of the known pixel circuit.
Figure 10B:
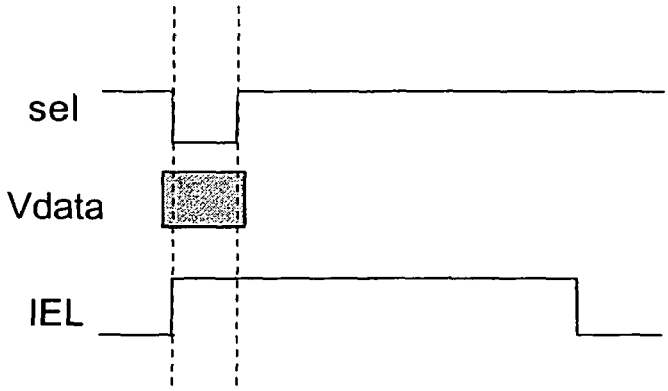

FIGS. 7(*a*), 8(*a*), and 9(*a*) show pixel circuits 101 realizing the second embodiment based on the pixel circuit 101 according to the first modification of the first embodiment shown in FIG. 3(*a*). FIG. 7(*a*) corresponds to FIG. 4(*a*), FIG. 8(*a*) corresponds to FIG. 5(*a*), and FIG. 9(*a*) corresponds to FIG. 6(*a*). Referring to FIG. 8(*a*), the fifth transistor T5 and the power-supply voltage VRF shown in FIG. 5(*a*) are omitted from the pixel circuit 101. This is because the same effect can be achieved as in FIG. 5(*a*) even without the fifth transistor T5 and the power-supply voltage VRF.

FIGS. 7(*b*), 8(*b*), and 9(*b*) are timing charts showing the operations of the pixel circuits 101 shown in FIGS. 7(*a*), 8(*a*), and 9(*a*), respectively. Since the principle of operations is the same as in the pixel circuits 101 shown in FIGS. 4(*a*), 5(*a*), 6(*a*), a detailed description is omitted here. It is expected that the same effect can be achieved in the pixel circuits 101 shown in FIGS. 7(*a*), 8(*a*), and 9(*a*) as in FIGS. 4(*a*), 5(*a*), and 6(*a*).

Figure 12A:
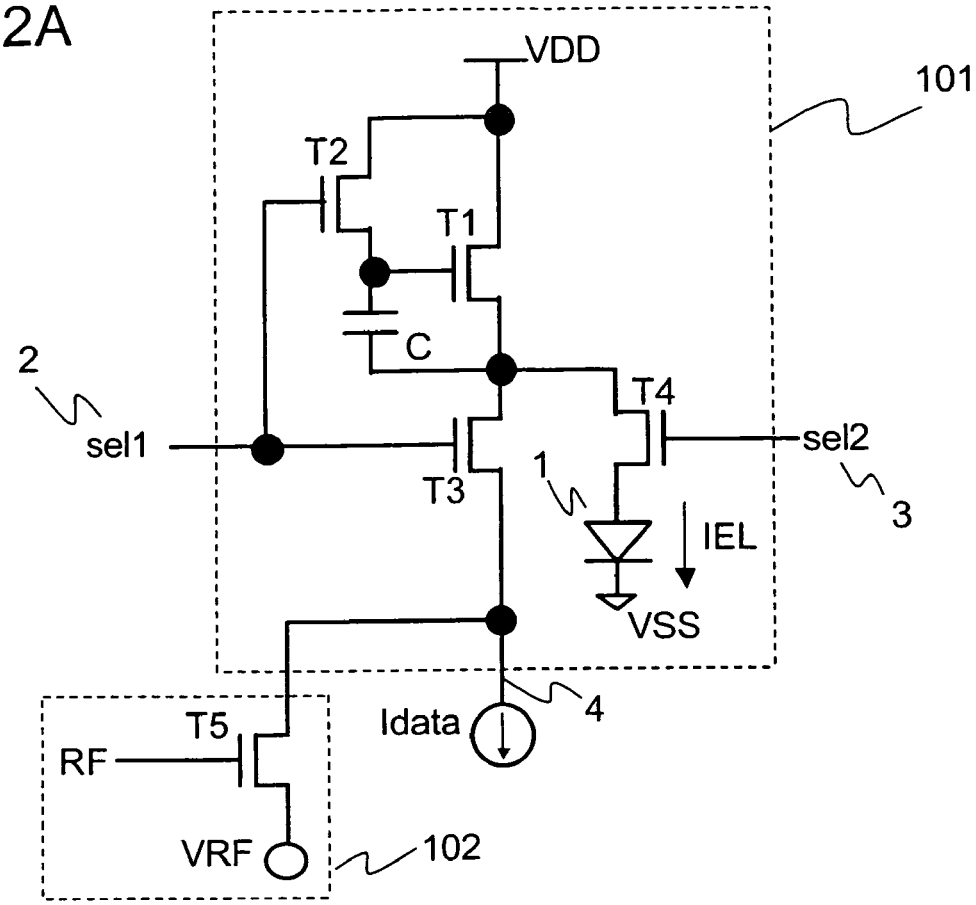
FIG. 12 includes a circuit diagram showing the structure of a pixel circuit according to still another modification of the second embodiment of the present invention and a timing chart showing the operation of the pixel circuit.
Figure 12B:
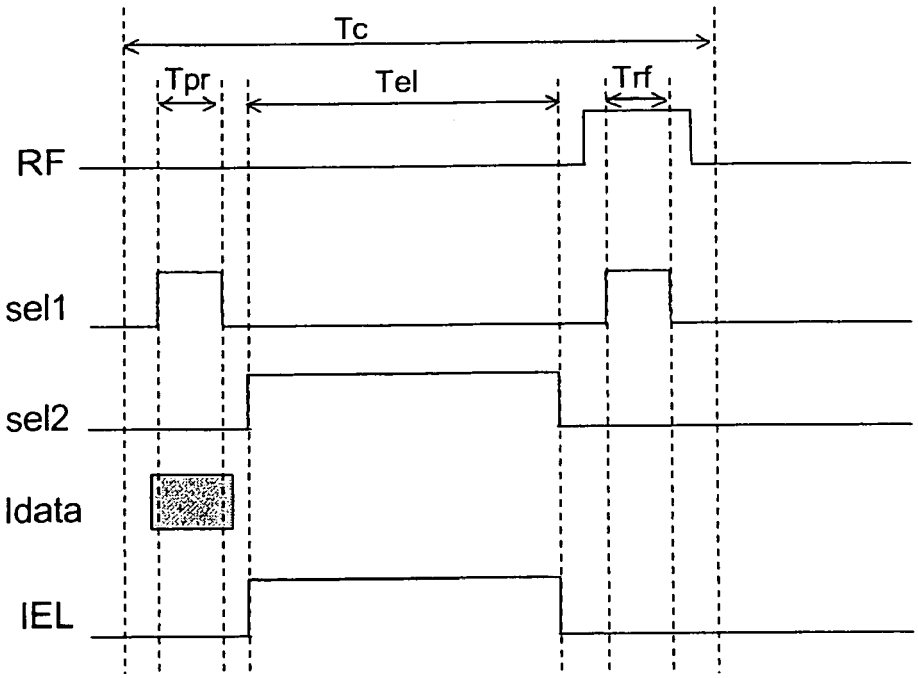
Figure 13A:
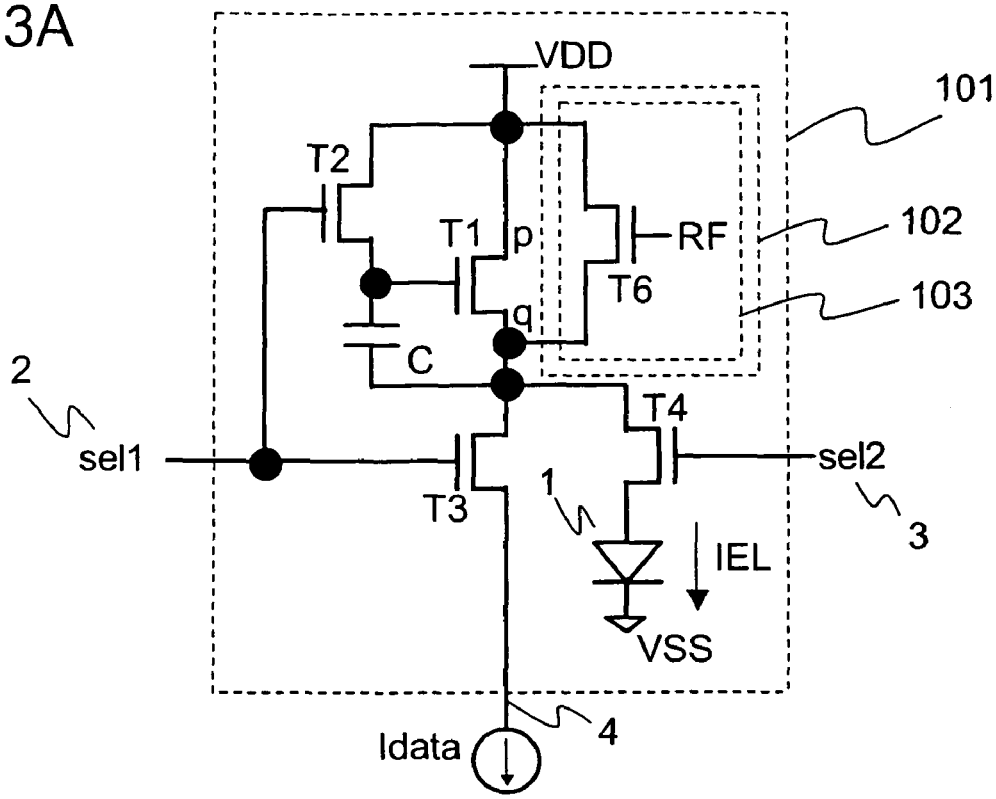
FIG. 13 includes a circuit diagram showing the structure of a pixel circuit according to still another modification of the second embodiment of the present invention and a timing chart showing the operation of the pixel circuit.
Figure 13B:
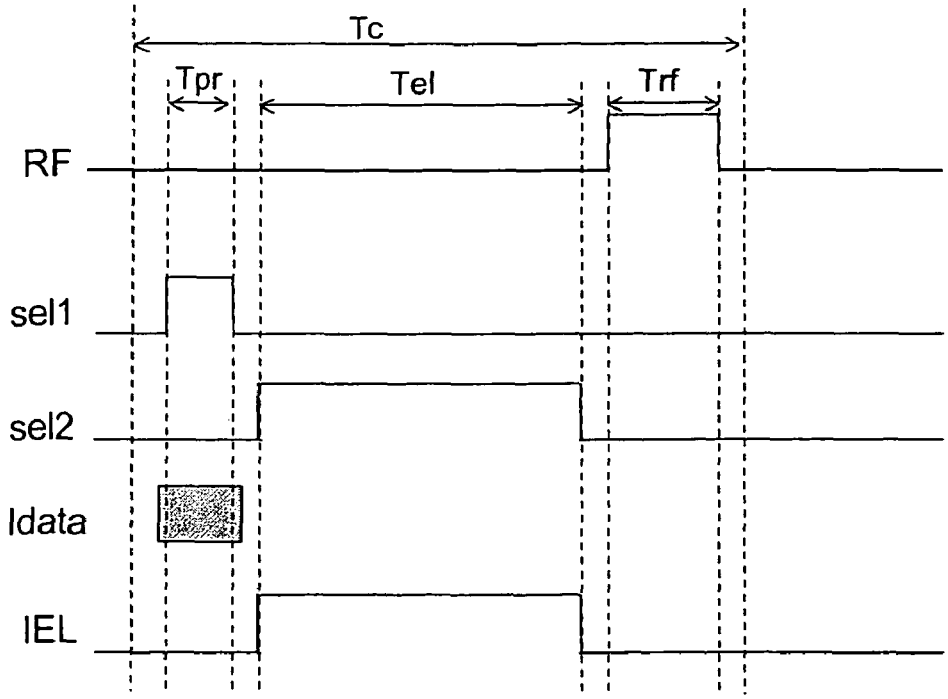
Figure 14A:
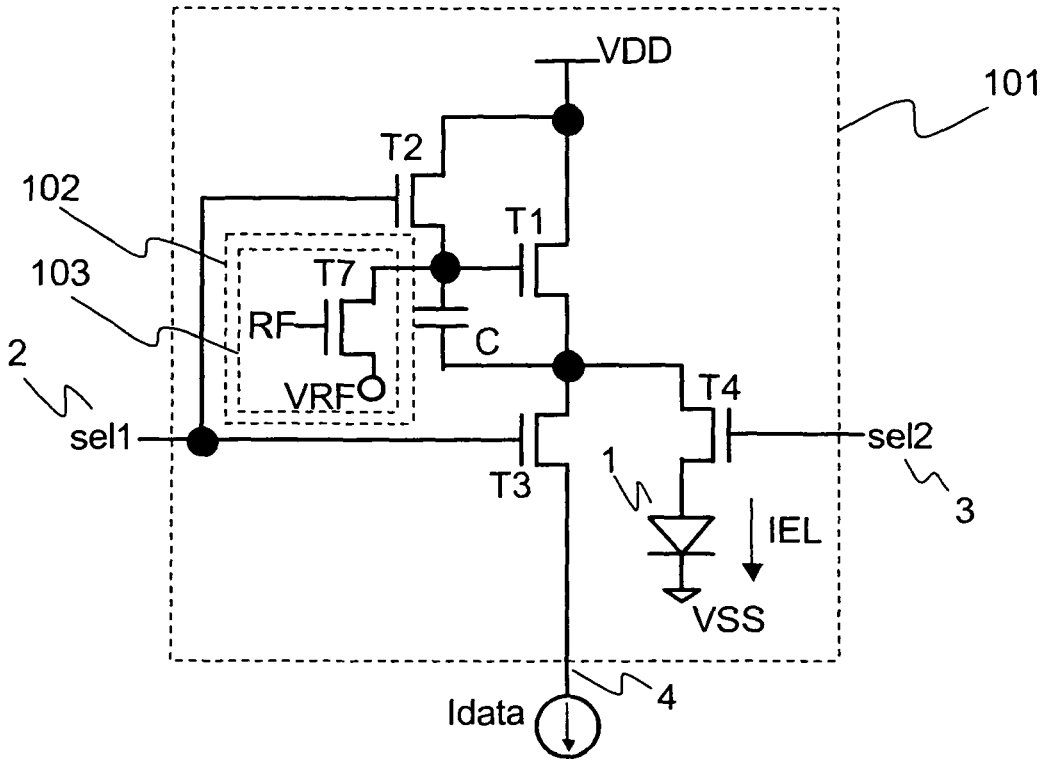
FIG. 14 includes a circuit diagram showing the structure of a pixel circuit according to still another modification of the second embodiment of the present invention and a timing chart showing the operation of the pixel circuit.
Figure 14B:
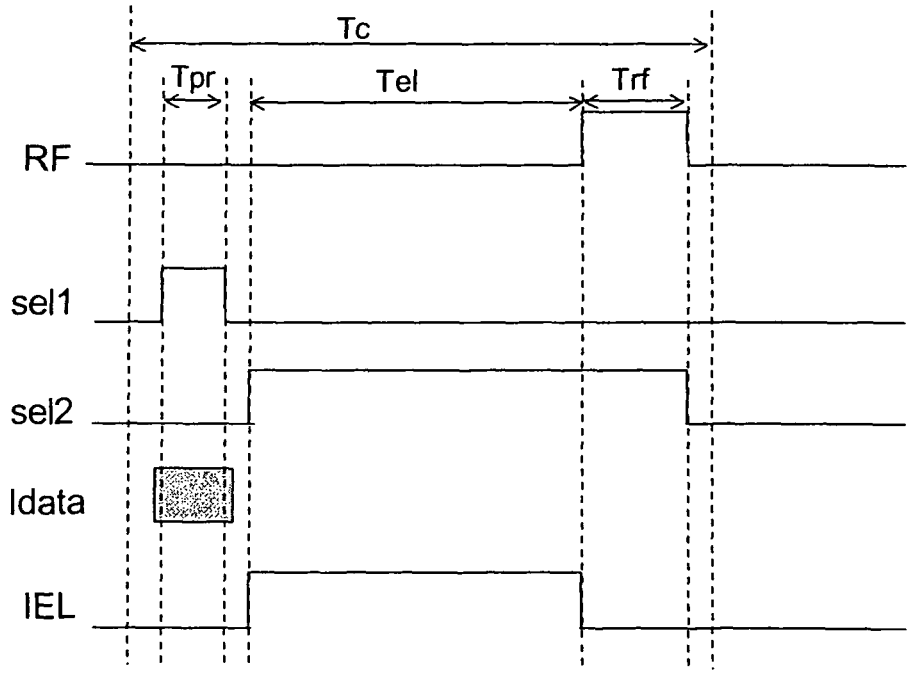

FIGS. 12(*a*), 13(*a*), and 14(*a*) show pixel circuits 101 realizing the second embodiment based on the pixel circuit 101 according to the second modification of the first embodiment shown in FIG. 11(*a*). FIG. 12(*a*) corresponds to FIG. 4(*a*), FIG. 13(*a*) corresponds to FIG. 5(*a*), and FIG. 14(*a*) corresponds to FIG. 6(*a*). Referring to FIG. 13(*a*), the fifth transistor T5 and the power-supply voltage VRF shown in FIG. 5(*a*) are omitted from the pixel circuit 101. This is because the same effect can be achieved as in FIG. 5(*a*) even without the fifth transistor T5 and the power-supply voltage VRF.

FIGS. 12(*b*), 13(*b*), and 14(*b*) are timing charts showing the operations of the pixel circuits 101 shown in FIGS. 12(*a*), 13(*a*), and 14(*a*), respectively. Since the principle of operations is the same as in the pixel circuits 101 shown in FIGS. 4(*a*), 5(*a*), 6(*a*), a detailed description is omitted here. It is expected that the same effect can be achieved in the pixel circuits 101 shown in FIGS. 12(*a*), 13(*a*), and 14(*a*) as in FIGS. 4(*a*), 5(*a*), and 6(*a*).

Figure 16A:
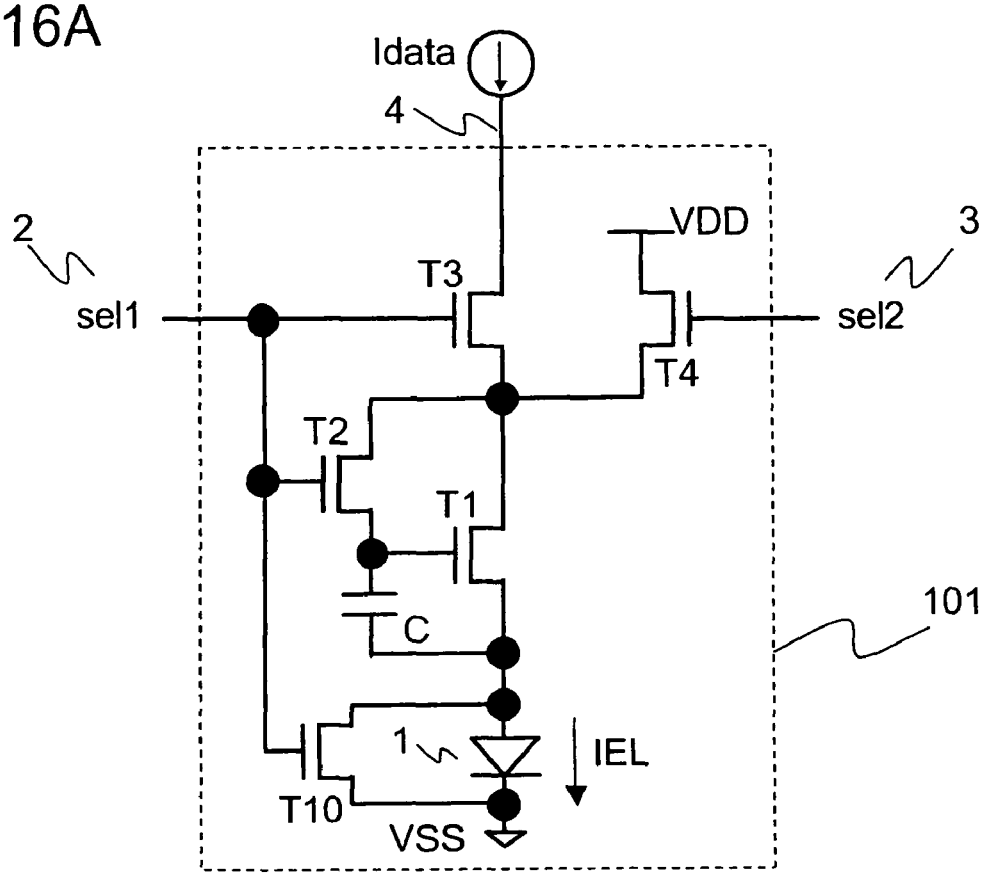
FIG. 16 includes a circuit diagram showing the structure of a pixel circuit according to still another modification of the second embodiment of the present invention and a timing chart showing the operation of the pixel circuit.
Figure 16B:
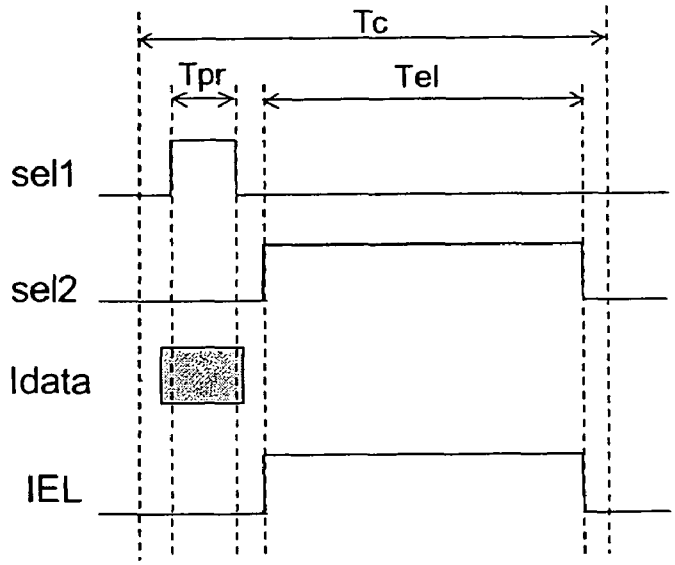
Figure 17A:
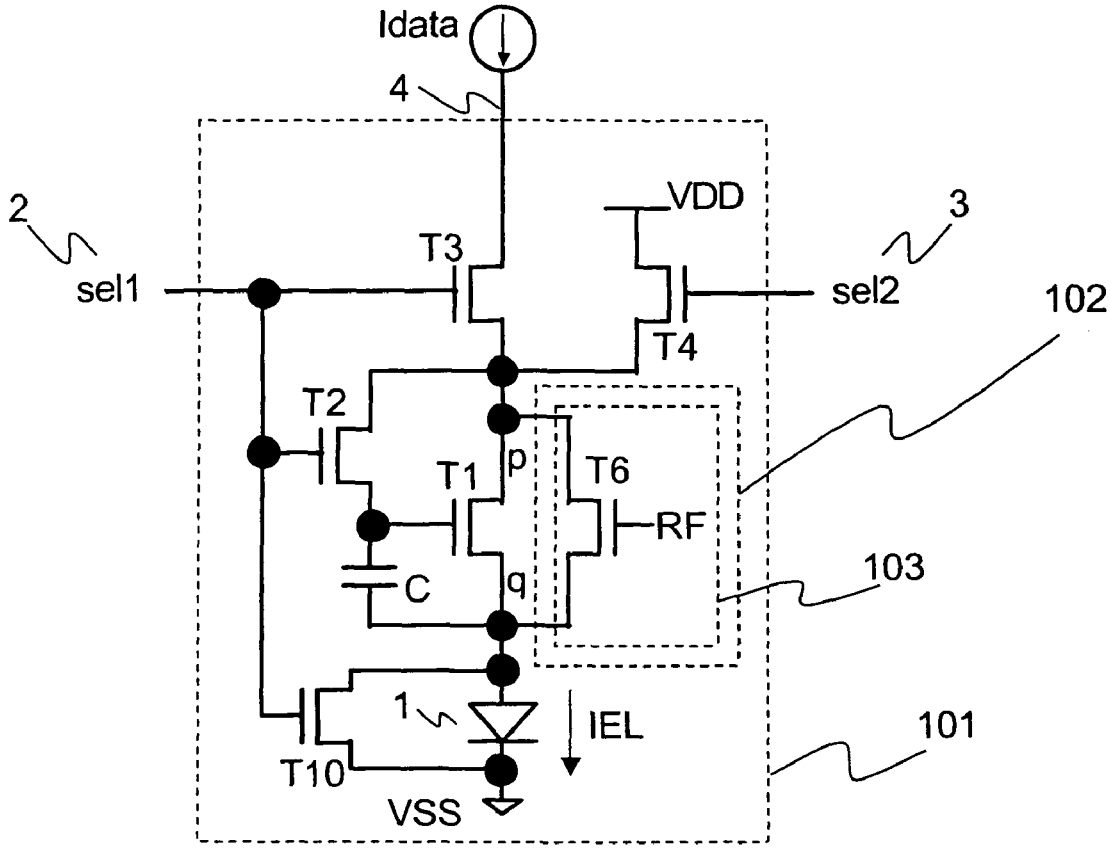
FIG. 17 includes a circuit diagram showing the structure of a pixel circuit according to still another modification of the second embodiment of the present invention and a timing chart showing the operation of the pixel circuit.
Figure 17B:
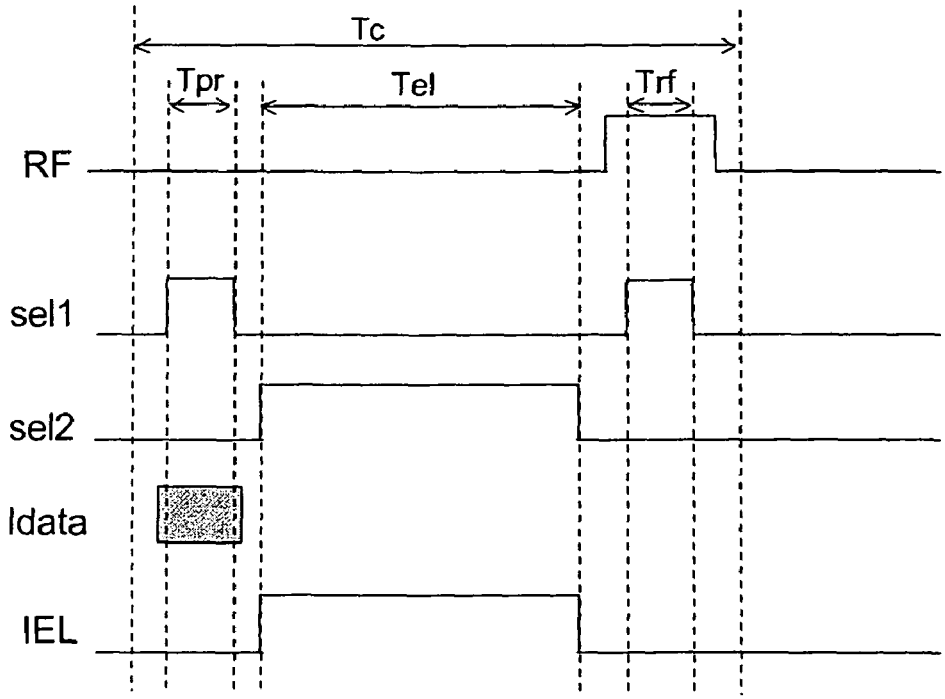
Figure 18A:
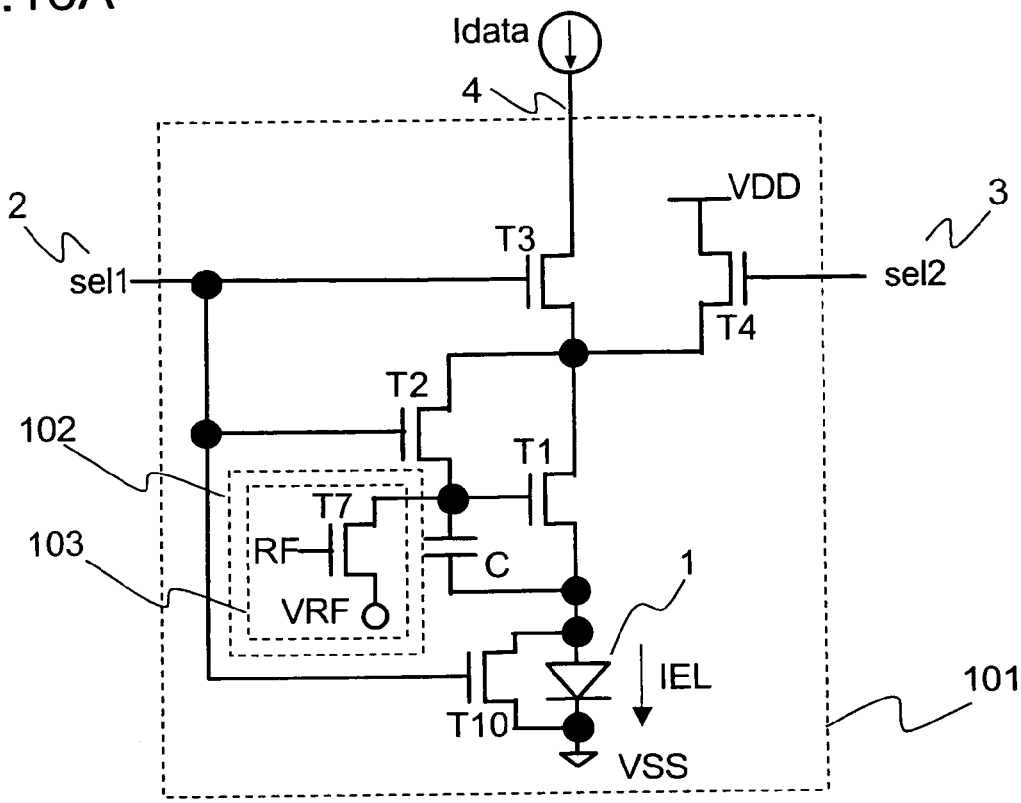
FIG. 18 includes a circuit diagram showing the structure of a pixel circuit according to still another modification of the second embodiment of the present invention and a timing chart showing the operation of the pixel circuit.
Figure 18B:
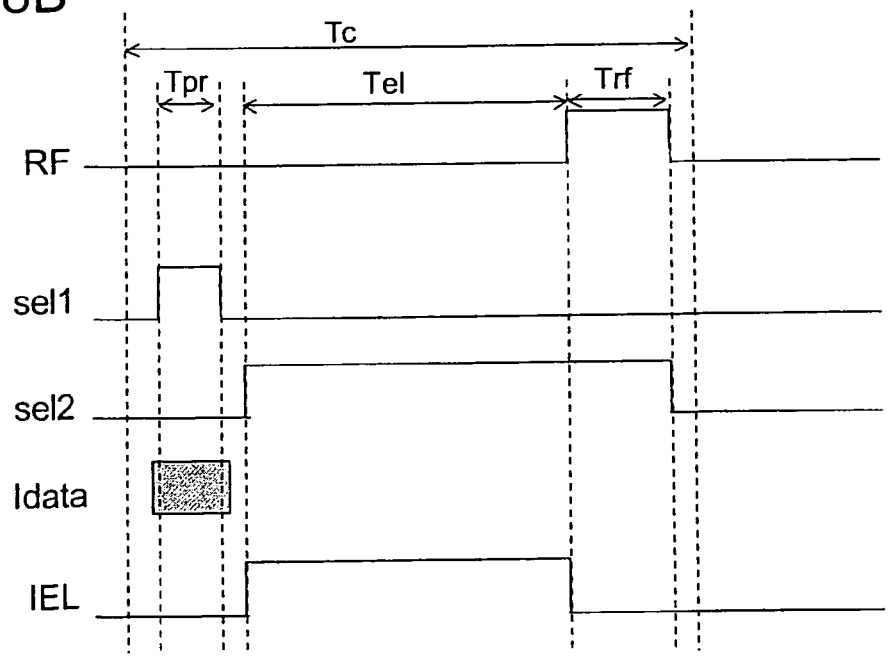

FIGS. 16(*a*), 17(*a*), and 18(*a*) show pixel circuits 101 realizing the second embodiment based on the pixel circuit 101 according to the third modification of the first embodiment shown in FIG. 15(*a*). FIG. 16(*a*) corresponds to FIG. 4(*a*), FIG. 17(*a*) corresponds to FIG. 5(*a*), and FIG. 18(*a*) corresponds to FIG. 6(*a*). Referring to FIG. 17(*a*), the fifth transistor T5 and the power-supply voltage VRF shown in FIG. 5(*a*) are omitted from the pixel circuit 101. This is because the same effect can be achieved as in FIG. 5(*a*) even without the fifth transistor T5 and the power-supply voltage VRF.

FIGS. 16(*b*), 17(*b*), and 18(*b*) are timing charts showing the operations of the pixel circuits 101 shown in FIGS. 16(*a*), 17(*a*), and 18(*a*), respectively. Since the principle of operations is the same as in the pixel circuits 101 shown in FIGS.

4(*a*), 5(*a*), 6(*a*), a detailed description is omitted here. It is expected that the same effect can be achieved in the pixel circuits 101 shown in FIGS. 16(*a*), 17(*a*), and 18(*a*) as in FIGS. 4(*a*), 5(*a*), and 6(*a*).

Although examples of the electro-optical apparatus using the organic EL device have been described in the above embodiments, it should be understood that the invention can be applied to an electro-optical apparatus or a display apparatus using a light-emitting device other than the organic EL device. For example, the invention can also be applied to an apparatus having another kind of light-emitting element, such as an LED or a field emitter display (FED), which can adjust the gradation of light emitted from the light-emitting element based on a driving current.

What is claimed is:

1. An electro-optical apparatus, comprising:

a plurality of gate lines;

a plurality of data lines; and a plurality of pixel circuits corresponding to intersections of the plurality of gate lines and the plurality of data lines, the pixel circuits including a light-emitting element having an anode and a cathode, a circuit that controls a gradation of light emitted from the light-emitting element, current-blocking means that blocks a current path of the light-emitting element, and a potential fixing circuit;

the light-emitting element being driven in a driving period including a light-emitting period and an adjusting period following the light-emitting period;

the pixel circuits having a function of setting the current-blocking means to an active state in at least part of a period in which current flows to the pixel circuits through the data lines; and the potential fixing circuit supplying a specified potential to a specified transistor included in the pixel circuits, in the adjusting period.

2. The electro-optical apparatus according to claim 1, wherein, in the adjusting period, the potential fixing circuit fixes the potential of at least one terminal of a gate, source or drain of the specified transistor included in the pixel circuits to a specified potential.

3. The electro-optical apparatus according to claim 1, a plurality of transistors included in the pixel circuits all having n-type polarity.

4. The electro-optical apparatus according to claim 3, cathodes of the light-emitting elements being commonly coupled among the plurality of the pixel circuits.

5. The electro-optical apparatus according to claim 1, the pixel circuits including amorphous silicon transistors.

6. The electro-optical apparatus according to claim 1, the light-emitting elements being organic EL elements.

7. An electro-optical apparatus, comprising:

a plurality of gate lines;

a plurality of data lines; and a plurality of pixel circuits corresponding to intersections of the plurality of gate lines and the plurality of data lines, the pixel circuits including a light-emitting element having an anode and a cathode, a circuit that controls a gradation of light emitted from the light-emitting element, short-circuiting means that connects the anode and the cathode of the light-emitting element, and a potential fixing circuit;

the light-emitting element being driven in a driving period including a light-emitting period and an adjusting period following the light-emitting period;

the pixel circuits having a function of setting the short-circuiting means to an active state in at least part of a period in which current flows to the pixel circuits through the data lines; and the potential fixing circuit supplying a specified potential to a specified transistor included in the pixel circuits, in the adjusting period.

8. A method of driving an electro-optical apparatus that comprises:

a plurality of gate lines;

a plurality of data lines; and a plurality of pixel circuits corresponding to intersections of the plurality of gate lines and the plurality of data lines, the pixel circuits including a light-emitting element having an anode and a cathode, a circuit that controls a gradation of light emitted from the light-emitting element, current-blocking means that blocks a current path of the light-emitting element, and a potential fixing circuit;

the method comprising:

driving the light-emitting element in a driving period including a light-emitting period and an adjusting period following the light-emitting period;

setting the current-blocking means to an active state, in at least part of a period in which current flows to the pixel circuits through the data lines; and supplying a specified potential to a specified transistor included in the pixel circuits, in the adjusting period.

9. A method of driving an electro-optical apparatus that comprises:

a plurality of gate lines;

a plurality of data lines; and a plurality of pixel circuits corresponding to intersections of the plurality of gate lines and the plurality of data lines, the pixel circuits including a light-emitting element having an anode and a cathode, a circuit that controls a gradation of light emitted from the light-emitting element, short-circuiting means that connects the anode and the cathode of the light-emitting element, and a potential fixing circuit;

the method comprising:

driving the light-emitting element in a driving period including a light-emitting period and an adjusting period following the light-emitting period;

setting the short-circuiting means to an active state, in at least part of a period in which current flows to the pixel circuits through the data lines; and supplying a specified potential to a specified transistor included in the pixel circuits, in the adjusting period.

* * * * *